US008043405B2

(12) United States Patent
Johnson, Jr. et al.

(10) Patent No.: US 8,043,405 B2
(45) Date of Patent: Oct. 25, 2011

(54) DENSIFIED MOLYBDENUM METAL POWDER

(75) Inventors: Loyal M. Johnson, Jr., Tucson, AZ (US); Sunil Chandra Jha, Oro Valley, AZ (US); Patrick Ansel Thompson, Tucson, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 396 days.

(21) Appl. No.: 12/338,827

(22) Filed: Dec. 18, 2008

(65) Prior Publication Data

US 2009/0116995 A1 May 7, 2009

Related U.S. Application Data

(60) Division of application No. 11/356,938, filed on Feb. 17, 2006, now Pat. No. 7,524,353, which is a continuation-in-part of application No. 10/970,456, filed on Oct. 21, 2004, now Pat. No. 7,276,102.

(51) Int. Cl.
*C22C 27/04* (2006.01)

(52) U.S. Cl. ..... 75/255; 148/423; 420/429

(58) Field of Classification Search ..... None
See application file for complete search history.

(56) References Cited

U.S. PATENT DOCUMENTS

| | | | | |
|---|---|---|---|---|
| 2,398,114 | A | | 4/1946 | Rennie |
| 2,402,084 | A | | 6/1946 | Rennie |
| 2,431,690 | A | | 12/1947 | Hall et al. |
| 2,776,887 | A | | 1/1957 | Kelly, Jr. et al. |
| 3,077,385 | A | | 2/1963 | Robb |
| 3,264,098 | A | | 8/1966 | Heytmeijer |
| 3,407,057 | A | | 10/1968 | Timmons |
| 3,865,573 | A | | 2/1975 | Neumann et al. |
| 3,907,546 | A | | 9/1975 | Port et al. |
| 3,973,948 | A | * | 8/1976 | Laferty et al. ..... 75/244 |
| 4,045,216 | A | | 8/1977 | Meyer et al. |
| 4,146,388 | A | | 3/1979 | Lafferty et al. |
| 4,216,034 | A | | 8/1980 | Miyake et al. |
| 4,331,544 | A | | 5/1982 | Takaya et al. |
| 4,454,105 | A | | 6/1984 | Wada et al. |
| 4,515,763 | A | | 5/1985 | Boudart et al. |
| 4,547,220 | A | | 10/1985 | Carpenter et al. |
| 4,552,749 | A | | 11/1985 | McHugh |
| 4,595,412 | A | | 6/1986 | Brunelli et al. |

(Continued)

FOREIGN PATENT DOCUMENTS

CA 2405917 C 1/2002

(Continued)

OTHER PUBLICATIONS

Notification of Transmittal of the International Search Report and the Written Opinion of the International Searching Authority, or the Declaration for PCT Application No. PCT/US2007/062325 mailed Aug. 4, 2008.

(Continued)

*Primary Examiner* — George Wyszomierski
(74) *Attorney, Agent, or Firm* — Fennemore Craig, P.C.

(57) ABSTRACT

Densified molybdenum metal powder. Densified molybdenum metal powder has substantially generally spherical particles, surface-area-to-mass ratio of no more than about 0.5 $m^2/g$ as determined by BET analysis, and a flowability greater than about 32 s/50 g as determined by a Hall Flowmeter.

7 Claims, 34 Drawing Sheets

100

U.S. PATENT DOCUMENTS

| | | | |
|---|---|---|---|
| 4,612,162 | A | 9/1986 | Morgan et al. |
| 4,613,371 | A | 9/1986 | Cheney et al. |
| 4,622,068 | A | 11/1986 | Rowe et al. |
| 4,724,128 | A | 2/1988 | Cheresnowsky et al. |
| 4,851,206 | A | 7/1989 | Boudart et al. |
| 4,915,733 | A | 4/1990 | Schiitz et al. |
| 5,063,021 | A | 11/1991 | Anand et al. |
| 5,124,091 | A | 6/1992 | Paliwal et al. |
| 5,173,108 | A | 12/1992 | Houck |
| 5,197,399 | A | 3/1993 | Mansour |
| 5,330,557 | A | 7/1994 | May |
| 5,403,375 | A | 4/1995 | Konig et al. |
| 5,427,761 | A | 6/1995 | Grindatto et al. |
| 5,874,684 | A | 2/1999 | Parker et al. |
| 6,042,370 | A | 3/2000 | Weide |
| 6,207,609 | B1 | 3/2001 | Gao et al. |
| 6,447,571 | B1 | 9/2002 | Ito et al. |
| 6,540,811 | B2 | 4/2003 | Hosoe et al. |
| 6,569,222 | B2 | 5/2003 | McCormick |
| 6,626,976 | B2 | 9/2003 | Khan et al. |
| 6,793,907 | B1 | 9/2004 | Singh et al. |
| 6,923,842 | B2 | 8/2005 | Furuya |
| 7,122,069 | B2 | 10/2006 | Dorfman et al. |
| 7,132,005 | B2 | 11/2006 | Khan et al. |
| 7,192,467 | B2 | 3/2007 | Khan et al. |
| 7,276,102 | B2 | 10/2007 | Johnson et al. |
| 7,470,307 | B2 | 12/2008 | Larink, Jr. |
| 2004/0206204 | A1 | 10/2004 | Holmqvist et al. |
| 2005/0061106 | A1 | 3/2005 | Ibaraki et al. |
| 2008/0213122 | A1 | 9/2008 | Johnson et al. |
| 2008/0271567 | A1 | 11/2008 | Larink |

FOREIGN PATENT DOCUMENTS

| | | | |
|---|---|---|---|
| EP | 1088788 | A2 | 4/2001 |
| EP | 1162281 | A1 | 12/2001 |
| EP | 1308526 | B1 | 9/2002 |
| GB | 932168 | | 7/1963 |
| JP | 58-113369 | | 7/1983 |
| JP | 61-201708 | | 9/1986 |
| JP | 5311212 | A | 11/1993 |
| JP | 09-125101 | | 5/1997 |
| JP | 2003-193152 | | 7/2003 |
| WO | 9824576 | | 6/1998 |
| WO | 2006/104925 | A3 | 10/2006 |

OTHER PUBLICATIONS

European Search Report for EP Patent Application No. 02022649.4 mailed Feb. 13, 2003, 3 pages.

International Preliminary Report on Patentability dated Dec. 27, 2007 for PCT Application No. PCT/US2006/010883 (8 pages).

Notification of Transmittal of the International Search Report and the Written Opinion of the International Searching Authority, or the Declaration for PCT Application No. PCT/US2006/010883 mailed Nov. 16, 2007, 4 pages.

Examination Report dated Nov. 13, 2008 for Application No. GB0705143.6, 3 pages.

Office Action dated Jan. 12, 2009 for Application No. 11557781, 8 pages.

Notice of Abandonment dated Apr. 21, 2008 for Application No. 11557801, 2 pages.

Notice of Abandonment dated Dec. 1, 2006 for Application No. 10346534, 2 pages.

Written Opinion of the International Searching Authority dated Nov. 16, 2007 for Application No. PCT/US2006/10883, 6 pages.

Notification of Transmittal of the International Search Report and the Written Opinion of the International Searching Authority, or the Declaration for PCT Application No. PCT/US2005/37496 mailed Mar. 1, 2007, 4 pages.

Written Opinion of the International Searching Authority dated Mar. 1, 2008 for Application No. PCT/US2005/37596, 4 pages.

Supplementary European Search Report dated Jan. 16, 2008 for Application No. EP04811652, 2 pages.

Non-Final Office Action dated Nov. 10, 2010 for U.S. Appl. No. 12/338,863, 17 pages.

* cited by examiner

Molybdenum metal power produced using AHM as the the ammonium molybdate precursor material.

Molybdenum metal power produced using AHM as the the ammonium molybdate precursor material.

Molybdenum metal power produced using AHM as the the ammonium molybdate precursor material.

Molybdenum metal power produced using ADM as the the ammonium molybdate precursor material.

Molybdenum metal power produced using ADM as the the ammonium molybdate precursor material.

Molybdenum metal power produced using ADM as the the ammonium molybdate precursor material.

Molybdenum metal power produced using AOM as the the ammonium molybdate precursor material.

Molybdenum metal power produced using AOM as the the ammonium molybdate precursor material.

Molybdenum metal power produced using AOM as the the ammonium molybdate precursor material.

100

100

100

100

100

100

100

100

200

200

200

DENSIFIED MOLYBDENUM METAL POWDER

CROSS REFERENCE TO RELATED APPLICATIONS

This is a divisional of U.S. application, Ser. No. 11/356,938, filed on Feb. 17, 2006, now U.S. Pat. No. 7,524,353, issued on Apr. 28, 2009, which is a continuation-in-part of U.S. application, Ser. No. 10/970,456, filed Oct. 21, 2004, now U.S. Pat. No. 7,276,102, issued on Oct. 2, 2007, both of which are hereby incorporated herein by reference for all that they disclose.

FIELD OF THE INVENTION

The invention generally pertains to molybdenum, and more specifically, to molybdenum metal powder and production thereof.

BACKGROUND OF THE INVENTION

Molybdenum (Mo) is a silvery or platinum colored metallic chemical element that is hard, malleable, ductile, and has a high melting point, among other desirable properties. Molybdenum occurs naturally in a combined state, not in a pure form. Molybdenum ore exists naturally as molybdenite (molybdenum disulfide, $MoS_2$).

Molybdenum ore may be processed by roasting to form molybdic oxide ($MoO_3$), which may be further processed to form pure molybdenum (Mo) metal powder. In its pure state, molybdenum metal is tough and ductile and is characterized by moderate hardness, high thermal conductivity, high resistance to corrosion, and a low expansion coefficient. Molybdenum metal may be used for electrodes in electrically heated glass furnaces, nuclear energy applications, and for casting parts used in missiles, rockets, and aircraft. Molybdenum metal may also be used in various electrical applications that are subject to high temperatures, such as X-ray tubes, electron tubes, and electric furnaces.

Because of its desirable properties, molybdenum powders are useful in spray coating and powder injection molding applications. The utility of molybdenum powders may be enhanced through densification. Since the outcome of sensitive metallurgical processes may be affected by molybdenum powders of varying densities, there developed a need for a densification process that could be easily controlled to produce a flowable molybdenum powder of a desired density and flowability, given certain cost parameters.

In addition, because of the desirable properties of molybdenum powders made through known plasma densification processes, there developed a need to produce beneficial densified molybdenum powders through a cheaper and more efficient process than previously known.

SUMMARY OF THE INVENTION

Densified molybdenum metal powder of the present invention includes particles of molybdenum metal having a surface-area-to-mass ratio of no more than about 0.5 $m^2/g$ as determined by BET analysis and a flowability greater than about 32 s/50 g as determined by a Hall Flowmeter, said particles comprising a densified form of a molybdenum metal powder precursor material having a surface-area-to-mass ratio of between about 1 $m^2/g$ and about 4 $m^2/g$, as determined by BET analysis, and a flowability of between about 29 s/50 g and about 86 s/50 g as determined by a Hall Flowmeter.

BRIEF DESCRIPTION OF THE DRAWINGS

Illustrative and presently preferred embodiments of the invention are illustrated in the drawings, in which.

DETAILED DESCRIPTION OF THE INVENTION

Novel molybdenum metal powder 10 has surface-area-to-mass-ratios in a range of between about 1.0 meters$^2$/gram ($m^2$/g) and about 3.0 $m^2$/g, as determined by BET analysis, in combination with a particle size wherein at least 30% of the particles have a particle size larger than a size +100 standard Tyler mesh sieve. In addition, molybdenum metal powder 10 may be further distinguished by flowability in a range of between about 29 seconds/50 grams (s/50 g) and about 64 s/50 g, as determined by a Hall Flowmeter, the temperature at which sintering begins, and the weight percent of oxygen present in the final product.

Molybdenum metal powder 10 having a relatively high surface-area-to-mass-ratio in combination with a relatively large particle size and excellent flowability provides advantages in subsequent powder metallurgy processes. For example, the low Hall flowability (i.e., a very flowable material) of the molybdenum metal powder 10 produced according to the present invention is advantageous in sintering processes because the molybdenum metal powder 10 will more readily fill mold cavities. The comparatively low sintering temperature (e.g., of about 950° C.) compared to about 1500° C. for conventional molybdenum metal powders, provides additional advantages as described herein.

Figure 1:
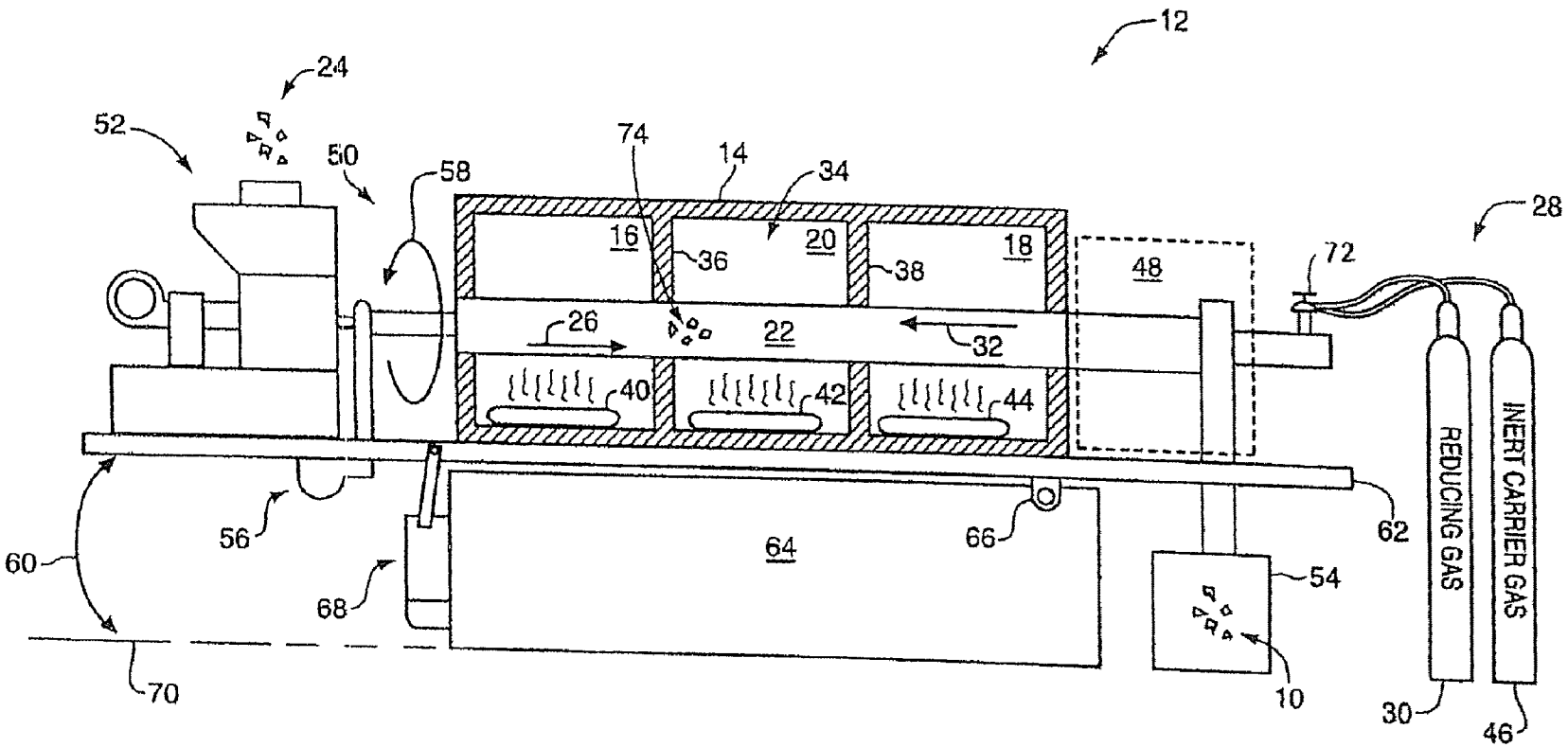
FIG. 1 is a cross-sectional schematic representation of one embodiment of an apparatus for producing molybdenum metal powder according to the invention.

The novel molybdenum metal powder 10 may be produced by apparatus 12 illustrated in FIG. 1. Apparatus 12 may comprise a furnace 14 having an initial heating zone 16, and a final heating zone 18. Optionally, the furnace 14 may be provided with an intermediate heating zone 20 located between the initial heating zone 16 and the final heating zone 18. A process tube 22 extends through the furnace 14 so that an ammonium molybdate precursor material 24 may be introduced into the process tube 22 and moved through the heating zones 16, 18, 20 of the furnace 14, such as is illustrated by arrow 26 shown in FIG. 1. A process gas 28, such as a hydrogen reducing gas 30, may be introduced into the process tube 22, such as is illustrated by arrow 32 shown in FIG. 1. Accordingly, the ammonium molybdate precursor material 24 is reduced to form or produce molybdenum metal powder 10.

A method 80 (FIG. 2) for production of the molybdenum metal powder 10 is also disclosed herein. Molybdenum metal powder 10 is produced from an ammonium molybdate precursor material 24. Examples of ammonium molybdate precursor materials 24 include ammonium heptamolybdate (AHM), ammonium dimolybdate (ADM), and ammonium octamolybdate (AOM). A method 80 for producing molybdenum metal powder 10 may comprise: i) providing 82 a supply of ammonium molybdate precursor material 24; ii) heating 84 the ammonium molybdate precursor material 24 at an initial temperature (e.g., in initial heating zone 16 of furnace 14) in the presence of a reducing gas 30, such as hydrogen, to produce an intermediate product 74; iii) heating 86 the intermediate product 74 at a final temperature (e.g., in final heating zone 18 of furnace 14) in the presence of the reducing gas 30; and iv) producing 88 molybdenum metal powder 10.

Having generally described the molybdenum metal powder 10, apparatus 12, and methods 80 for production thereof, as well as some of the more significant features and advantages of the invention, the various embodiments of the invention will now be described in further detail.

Novel Forms of Molybdenum Metal Powder

Novel molybdenum metal powder 10 has surface-area-to-mass-ratios in a range of between about 1.0 meters$^2$/gram ($m^2/g$) and about 3.0 $m^2/g$, as determined by BET analysis, in combination with a particle size wherein at least 30% of the particles have a particle size larger than a size +100 standard Tyler mesh sieve. In addition, molybdenum metal powder 10 may be further distinguished by flowabilities in a range of between about 29 seconds/50 grams (s/50 g) and about 64 s/50 g, as determined by a Hall Flowmeter, the temperature at which sintering begins, and the weight percent of oxygen present in the final product. As can readily be seen in FIGS. 4, 7, & 10, the combination of these unique characteristics, results in particles of novel molybdenum metal powder 10 having a generally round ball-like appearance with a very porous surface, similar to that of a round sponge.

The molybdenum metal powder 10 may have surface-area-to-mass-ratios in a range of between about 1.0 meters$^2$/gram ($m^2/g$) and about 3.0 $m^2/g$, as determined by BET analysis. More specifically, the molybdenum metal powder 10 may have surface-area-to-mass-ratios in the range of between about 1.32 $m^2/g$ and about 2.56 $m^2/g$, as determined by BET analysis. The high BET results are obtained even though the particle size is comparatively large (i.e., about 60 μm or 60,000 nm). Comparatively high BET results are more commonly associated with nano-particles having sizes considerably smaller than 1 μm (1,000 nm). Here, the molybdenum metal powder 10 particles are quite novel because the particles are considerably larger, having sizes of about 60 μm (60,000 nm), in combination with high BET results between about 1.32 $m^2/g$ and about 2.56 $m^2/g$.

The molybdenum metal powder 10 particles have a particle size wherein at least 30% of the particles have a particle size larger than a size +100 standard Tyler mesh sieve. More specifically, the molybdenum metal powder 10 particles have a particle size wherein at least 40% of the particles have a particle size larger than a size +100 standard Tyler mesh sieve. Additionally, the molybdenum metal powder 10 particles have a particle size wherein at least 20% of the particles have a particle size smaller than a size −325 standard Tyler mesh sieve. Standard Tyler screen sieves with diameters of 8 inches were used to obtain the results herein.

The unique combination of high BET and larger particle size can readily be seen in FIGS. 3-11, illustrating the porous particle surface, which is similar in appearance to that of a sponge. The porous surface of the molybdenum metal powder 10 particles increases the surface-area-to-mass-ratio of the particles, providing the higher BET results. In contrast, molybdenum metal powder 10 particles that may be produced according to prior art processes have a generally smooth surface (i.e., nonporous), resulting in relatively low surface-area-to-mass-ratios (i.e., low BET results).

The relatively large particle size in combination with the approximately spherical shape of the particles contributes to low Hall flowability, making the molybdenum metal powder 10 a very flowable material and thus a good material for subsequent sintering and other powder metallurgy applications. Molybdenum metal powder 10 has flowability between about 29 s/50 g and about 64 s/50 g as determined by a Hall Flowmeter. More specifically, flowability of between about 58 s/50 g and about 63 s/50 g was determined by a Hall Flowmeter.

The molybdenum metal powder 10 may also be distinguished by its final weight percent of oxygen. Molybdenum metal powder 10 comprises a final weight percent of oxygen less than about 0.2%. Final weight percent of oxygen less than about 0.2% is a particularly low oxygen content, which is desirable for many reasons. Lower weight percent of oxygen enhances subsequent sintering processes. A higher weight percent of oxygen can often react negatively with the hydrogen gas used in the sintering furnace and produce water, or lead to higher shrinkage and/or structure problems, such as vacancies. The identification of molybdenum metal powder 10 with such an advantageous weight percent of oxygen contributes to increased manufacturing efficiency.

Additionally, molybdenum metal powder 10 may be distinguished by the temperature at which sintering begins. The molybdenum metal powder 10 begins to sinter at about 950° C., which is a notably low temperature for sintering molybdenum metal. Typically, conventionally produced molybdenum metal powder does not begin to sinter until about 1500° C. The ability of the molybdenum metal powder 10 to be highly flowable and begin to sinter at such low temperatures has significant advantages including, for example, decreasing manufacturing expenses, increasing manufacturing efficiency, and reducing shrinkage.

Molybdenum metal powder 10 may have slightly different characteristics than those specifically defined above (e.g., surface-area-to-mass-ratio, particle size, flowability, oxygen content, and sintering temperature) depending upon the ammonium molybdate precursor material 24 used to produce the molybdenum metal powder 10. The ammonium molybdate precursor materials 24 which have been used with good results to produce molybdenum metal power 10 include ammonium dimolybdate $(NH_4)_2Mo_2O_7$ (ADM), ammonium heptamolybdate $(NH_4)_6Mo_7O_{24}$ (AHM), and ammonium octamolybdate $(NH_4)_4Mo_8O_{26}$ (AOM).

While the best results have been obtained utilizing AHM as the ammonium molybdate precursor material 24, ADM and AOM have also been used with good results. The ammonium molybdate precursor materials 24 are produced by and commercially available from Climax Molybdenum Company in Fort Madison, Iowa.

Figure 3:
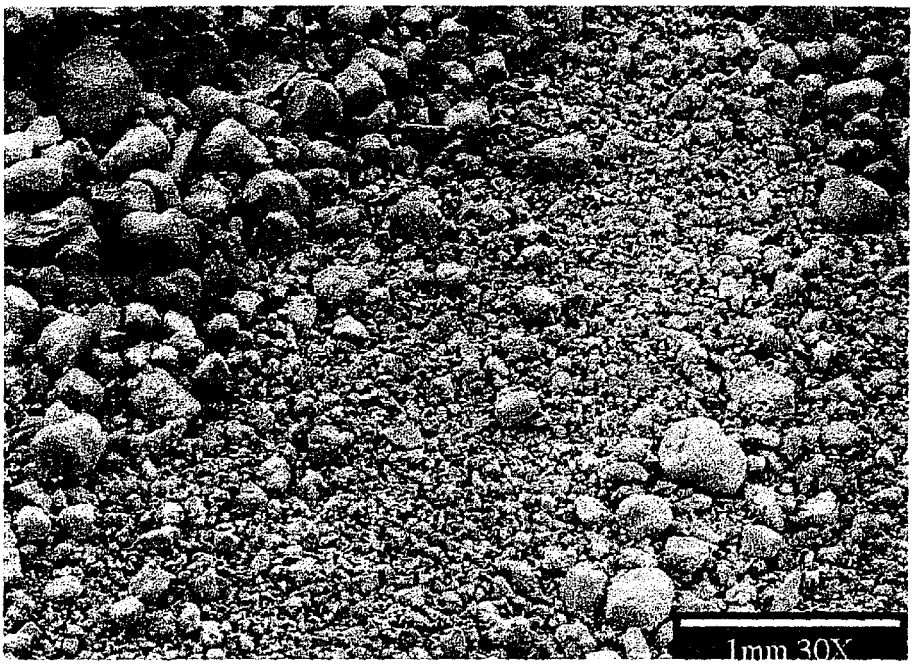
FIG. 3 is a scanning electron microscope image of the molybdenum metal powder such as may be produced according to one embodiment of the present invention wherein the ammonium molybdate precursor material is AHM.
Figure 4:
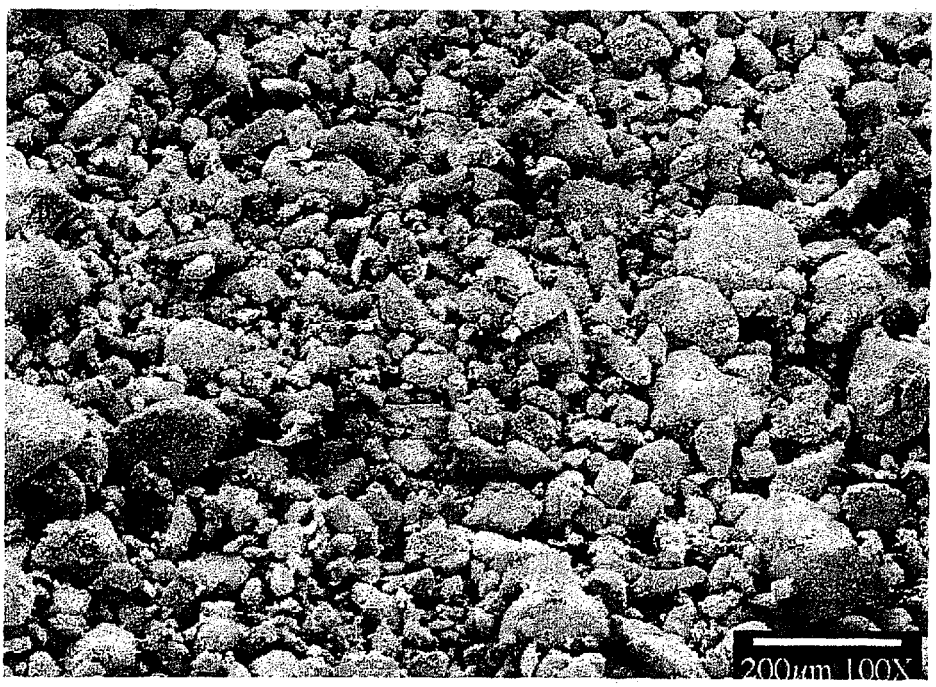
FIG. 4 is a scanning electron microscope image of the molybdenum metal powder such as may be produced according to one embodiment of the present invention wherein the ammonium molybdate precursor material is AHM.
Figure 5:
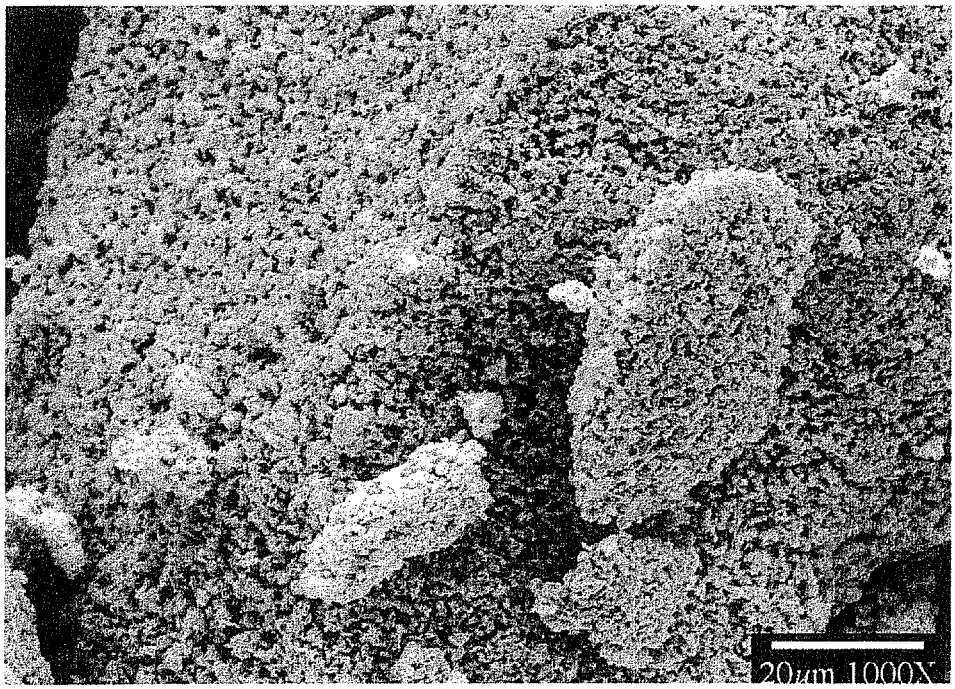
FIG. 5 is a scanning electron microscope image of the molybdenum metal powder such as may be produced according to one embodiment of the present invention wherein the ammonium molybdate precursor material is AHM.

FIGS. 3-5 are scanning electron microscope images of molybdenum metal powder 10 such as may be produced according to one embodiment of the present invention wherein the ammonium molybdate precursor material 24 was AHM. AHM is produced by and is commercially available from Climax Molybdenum Company in Fort Madison, Iowa (CAS No: 12054-85-2).

Generally, AHM may be an advantageous ammonium molybdate precursor material 24 when the final product desired must have a relatively low oxygen content and be highly flowable for applications such as sintering, for example. Using AHM as the ammonium molybdate precursor material 24 generally results in a more spherical molybdenum metal powder 10, as shown in FIGS. 3 & 4. The spherical shape of the molybdenum metal powder 10 contributes to the high flowability (i.e., it is a very flowable material) and excellent sintering ability. The porous surface of the molybdenum metal powder 10 produced from AHM increases the surface-area-to-mass-ratio and can readily been seen in FIG. 5. Generally, molybdenum metal powder 10 produced from AHM is more flowable and has a lower oxygen content than molybdenum metal powder 10 produced from AOM or ADM.

Figure 6:
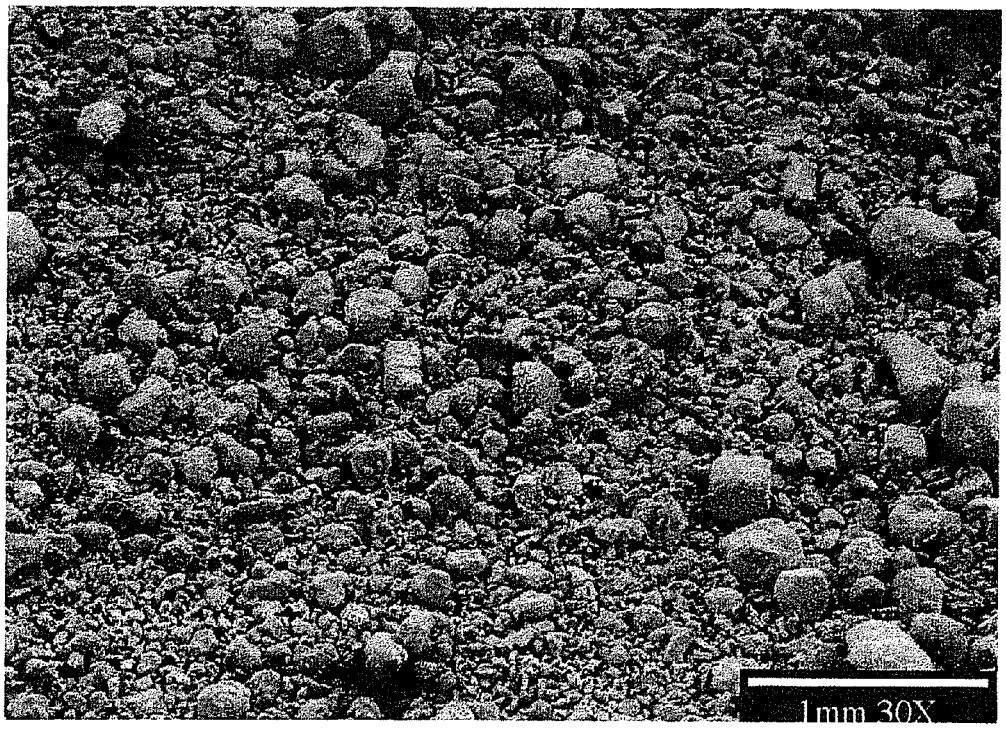
FIG. 6 is a scanning electron microscope image of the molybdenum metal powder such as may be produced according to one embodiment of the present invention wherein the ammonium molybdate precursor material is ADM.
Figure 7:
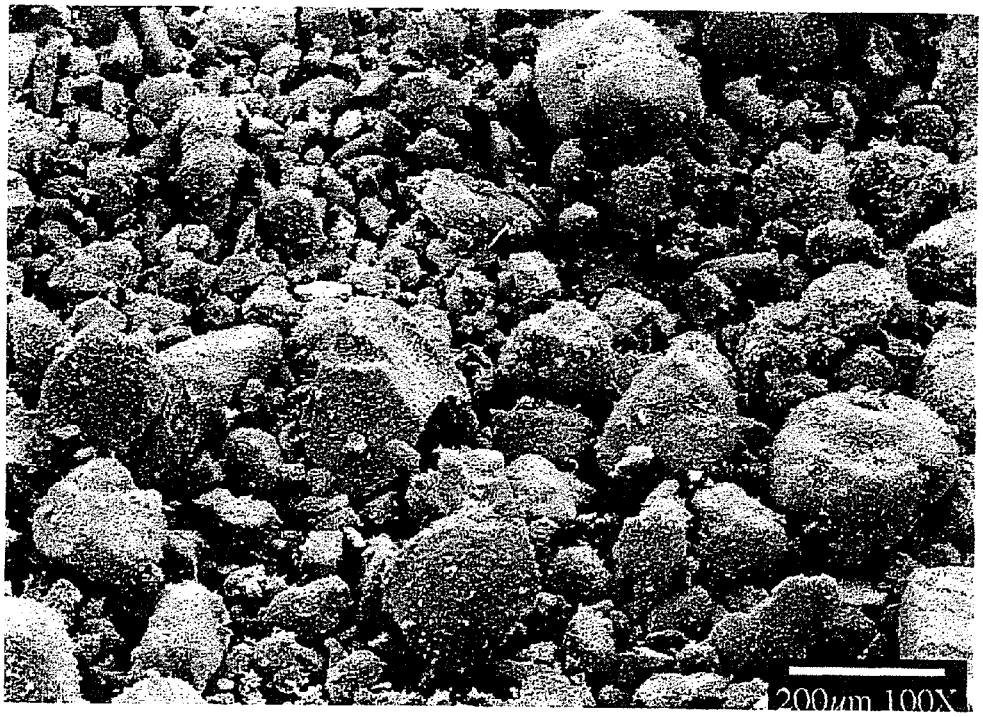
FIG. 7 is a scanning electron microscope image of the molybdenum metal powder such as may be produced according to one embodiment of the present invention wherein the ammonium molybdate precursor material is ADM.
Figure 8:
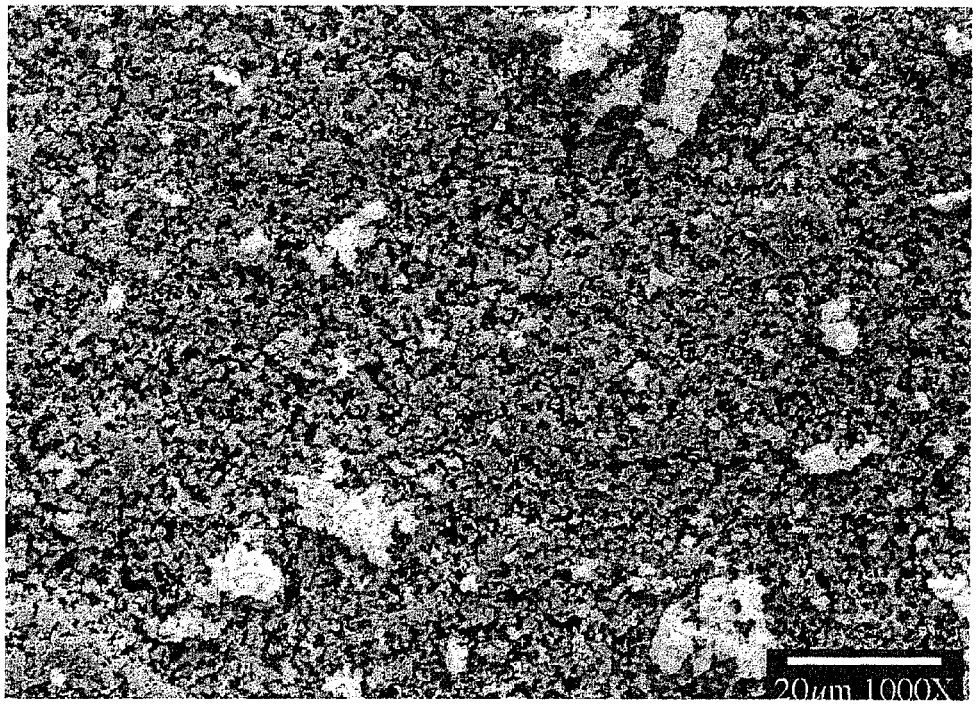
FIG. 8 is a scanning electron microscope image of the molybdenum metal powder such as may be produced according to one embodiment of the present invention wherein the ammonium molybdate precursor material is ADM.

FIGS. 6-8 are scanning electron microscope images of molybdenum metal powder 10 such as may be produced according to one embodiment of the present invention wherein the ammonium molybdate precursor material 24 was ADM. ADM is produced by and is commercially available from Climax Molybdenum Company in Fort Madison, Iowa (CAS No: 27546-07-2).

Using ADM as the ammonium molybdate precursor material 24 generally results in a more coarse molybdenum metal power 10 than that produced from AHM, as seen in FIGS. 6 & 7. Molybdenum metal powder 10 produced from ADM also has a higher oxygen content and a lower flowability (as shown in Example 13) compared to molybdenum metal powder 10 produced from AHM. The porous surface of the molybdenum metal powder 10 produced from ADM increases the surface-area-to-mass-ratio and can readily been seen in FIG. 8. Generally, the molybdenum metal powder 10 produced from ADM has a combination of high BET (i.e., surface-area-to-mass-ratio) and larger particle size.

Figure 9:
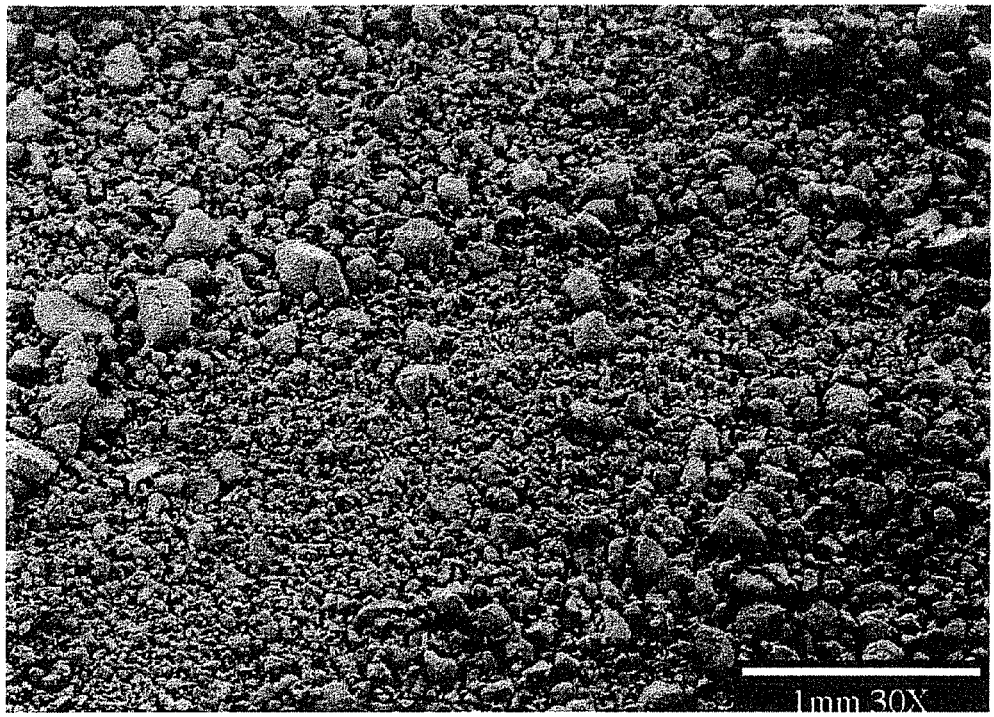
FIG. 9 is a scanning electron microscope image of the molybdenum metal powder such as may be produced according to one embodiment of the present invention wherein the ammonium molybdate precursor material is AOM.
Figure 10:
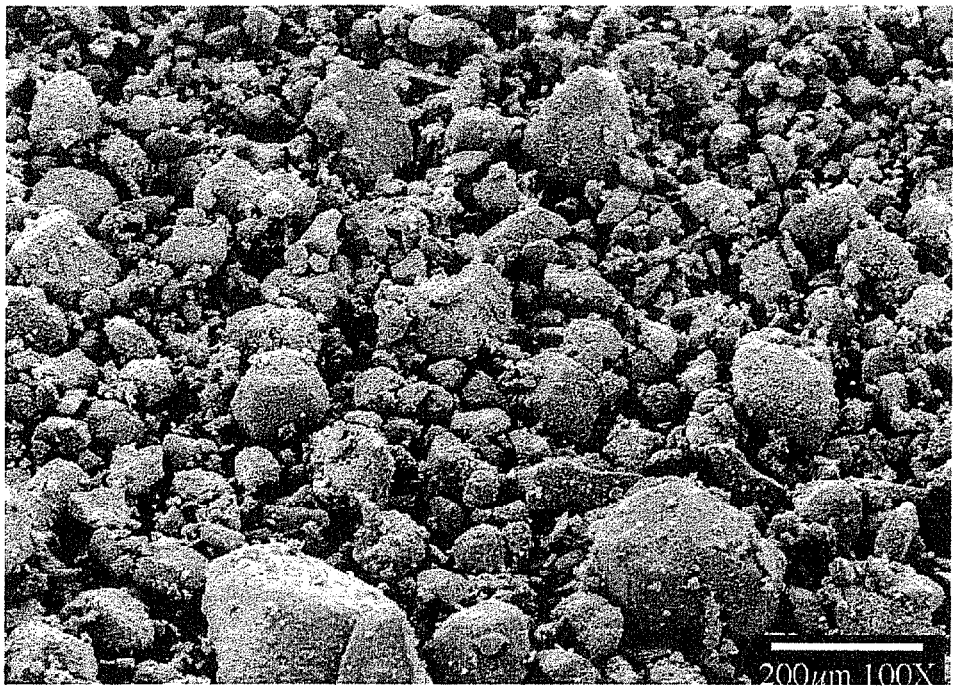
FIG. 10 is a scanning electron microscope image of the molybdenum metal powder such as may be produced according to one embodiment of the present invention wherein the ammonium molybdate precursor material is AOM.
Figure 11:
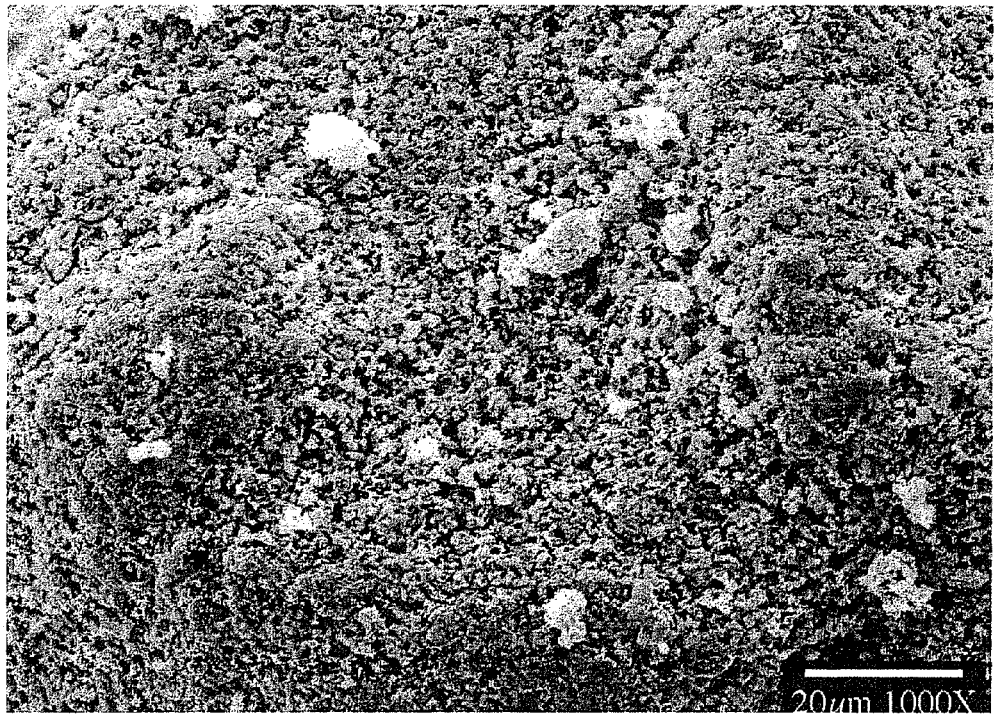
FIG. 11 is a scanning electron microscope image of the molybdenum metal powder such as may be produced according to one embodiment of the present invention wherein the ammonium molybdate precursor material is AOM.
Figure 12:
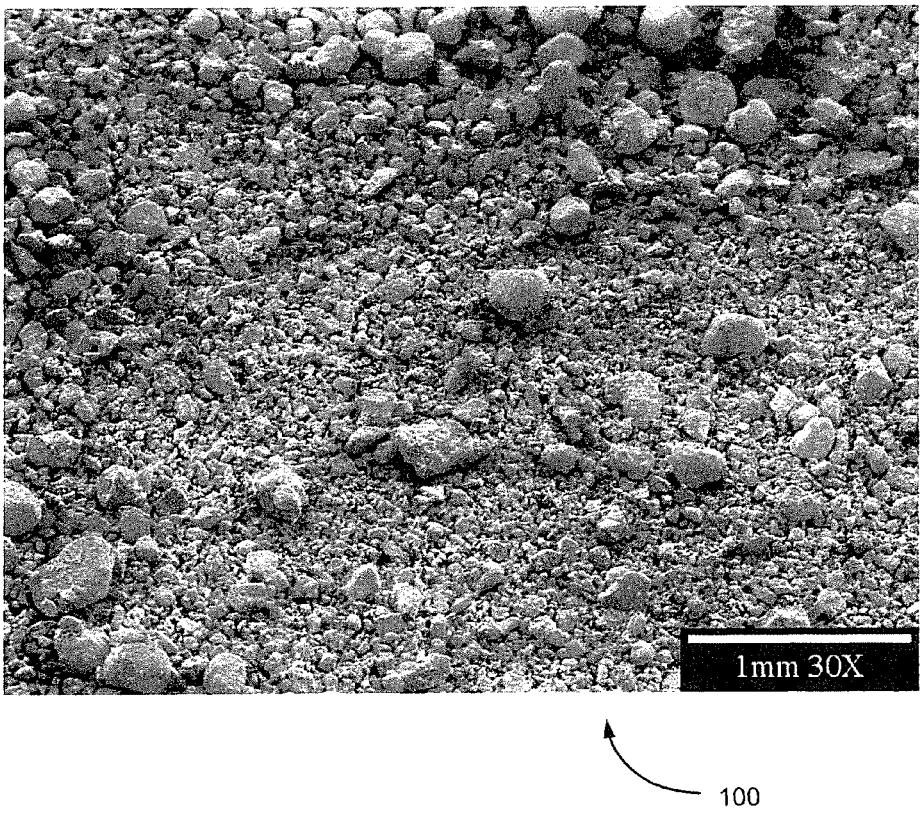
FIG. 12 is a scanning electron microscope image (1 mm 30×) of low temperature densified molybdenum metal powder such as may be produced according to one embodiment of the present invention wherein the molybdenum metal powder precursor material is densified at a temperature of about 1065° C.
Figure 13:
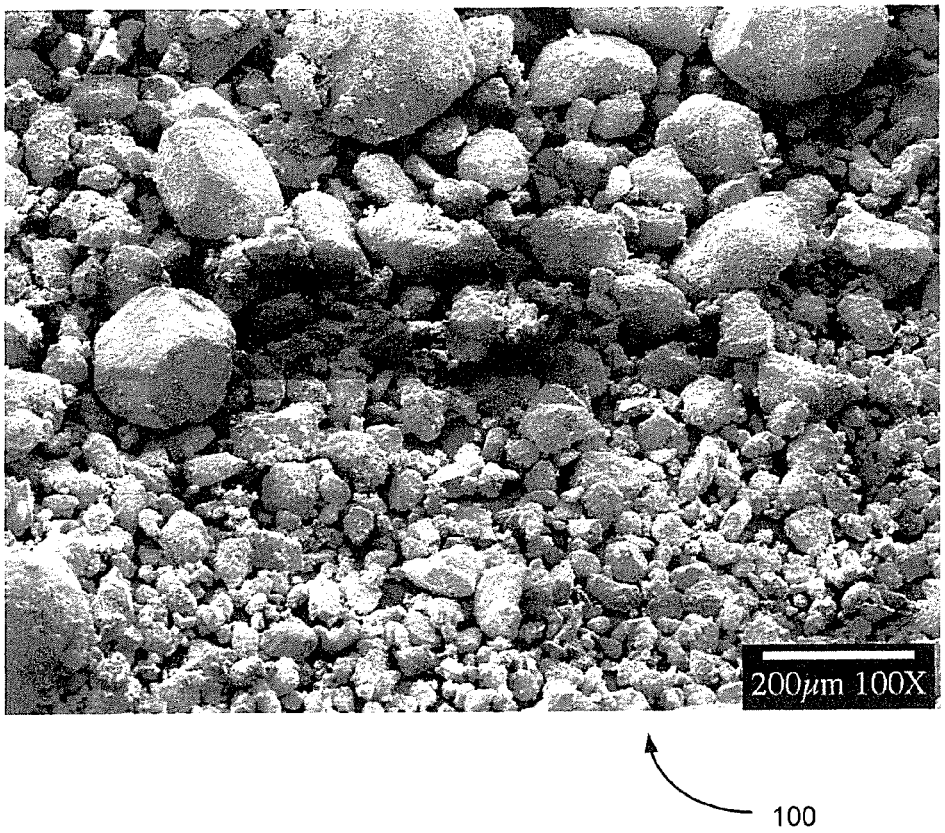
FIG. 13 is a scanning electron microscope image (200 μm 100×) of low temperature densified molybdenum metal powder such as may be produced according to one embodiment of the present invention wherein the molybdenum metal powder precursor material is densified at a temperature of about 1065° C.

FIGS. 9-11 are scanning electron microscope images of molybdenum metal powder 10 such as may be produced according to one embodiment of the present invention wherein the ammonium molybdate precursor material 24 was AOM. The AOM is produced by and is commercially available from Climax Molybdenum Company in Fort Madison, Iowa (CAS No: 12411-64-2).

Using AOM as the ammonium molybdate precursor material 24 generally results in a more coarse molybdenum metal power 10 than that produced from AHM, as seen in FIGS. 9 & 10. Molybdenum metal powder 10 produced from AOM also has a higher oxygen content and a lower flowability (as shown in Example 14) compared to molybdenum metal powder 10 produced from AHM. The porous surface of the molybdenum metal powder 10 produced from AOM increases the surface-area-to-mass-ratio and can readily been seen in FIG. 11. Generally, the molybdenum metal powder 10 produced from AOM has a combination of high BET (i.e., surface-area-to-mass-ratio) and larger particle size.

Selection of the ammonium molybdate precursor material 24 may depend on various design considerations, including but not limited to, the desired characteristics of the final molybdenum metal powder 10 (e.g., surface-area-to-mass-ratio, size, flowability, sintering ability, sintering temperature, final weight percent of oxygen, purity, etc.).

Apparatus for Producing Molybdenum Metal Powder

FIG. 1 is a schematic representation of an embodiment of an apparatus 12 used for producing molybdenum metal powder 10. This description of apparatus 12 provides the context for the description of the method 80 used to produce molybdenum metal powder 10.

Apparatus 12 may comprise a rotating tube furnace 14 having at least initial heating zone 16 and final heating zone 18. Optionally, the furnace 14 may also be provided with intermediate heating zone 20 located between the initial heating zone 16 and the final heating zone 18. A process tube 22 extends through the furnace 14 so that an ammonium molybdate precursor material 24 may be introduced into the process tube 22 and moved through the heating zones 16, 18, 20 of the furnace 14, such as is illustrated by arrow 26 shown in FIG. 1. Process gas 28, such as hydrogen reducing gas 30, may be introduced into the process tube 22, such as is illustrated by arrow 32 shown in FIG. 1.

The furnace 14 preferably comprises a chamber 34 formed therein. The chamber 34 defines a number of controlled heating zones 16, 18, 20 surrounding the process tube 22 within the furnace 14. The process tube 22 extends in approximately equal portions through each of the heating zones 16, 18, 20. The heating zones 16, 18, 20 are defined by refractory dams 36, 38. The furnace 14 may be maintained at the desired temperatures using any suitable temperature control apparatus (not shown). Heating elements 40, 42, 44 positioned within each of the heating zones 16, 18, 20 of the furnace 14 provide sources of heat.

The process gas 28 may comprise reducing gas 30 and an inert carrier gas 46. The reducing gas 30 may be hydrogen gas, and the inert carrier gas 46 may be nitrogen gas. The reducing gas 30 and the inert carrier gas 46 may be stored in separate gas cylinders near the far end of the process tube 22, as shown in FIG. 1. The process gas 28 is introduced into the process tube 22 through gas inlet 72, and directed through the cooling zone 48 (illustrated by dashed outline in FIG. 1) and through each of the heating zones 16, 18, 20, in a direction opposite (i.e., counter-current, as illustrated by arrow 32) to the direction that the precursor material 24 is moved through each of the heating zones 16, 18, 20 of the furnace 14.

The process gas 28 may also be used to maintain a substantially constant pressure within the process tube 22. In one embodiment of the invention, the process tube 22 may maintain water pressure at about 8.9 to 14 cm (about 3.5 to 5.5 in). The process tube 22 may be maintained at a substantially constant pressure by introducing the process gas 28 at a predetermined rate, or pressure, into the process tube 22, and discharging any unreacted process gas 28 at a predetermined rate, or pressure, therefrom to establish the desired equilibrium pressure within the process tube 22. The discharge gas may be bubbled through a water scrubber (not shown) to maintain the interior water pressure of the furnace 14 at approximately 11.4 cm (4.5 in).

Apparatus 12 may also comprise a transfer system 50. The transfer system 50 may also comprise a feed system 52 for feeding the ammonium molybdate precursor material 24 into the process tube 22, and a discharge hopper 54 at the far end of the process tube 22 for collecting the molybdenum metal powder 10 that is produced in the process tube 22.

The process tube 22 may be rotated within the chamber 34 of the furnace 14 via the transfer system 50 having a suitable drive assembly 56. The drive assembly 56 may be operated to rotate the process tube 22 in either a clockwise or counter-clockwise direction, as illustrated by arrow 58 in FIG. 1. The process tube 22 may be positioned at an incline 60 within the chamber 34 of the furnace 14.

The process tube 22 may be assembled on a platform 62, and the platform 62 may be hinged to a base 64 so that the platform 62 may pivot about an axis 66. A lift assembly 68 may also engage the platform 62. The lift assembly 68 may be operated to raise or lower one end of the platform 62 with respect to the base 64. The platform 62, and hence the process tube 22, may be adjusted to the desired incline with respect to the grade 70.

Although one embodiment of apparatus 12 is shown in FIG. 1 and has been described above, it is understood that other embodiments of apparatus 12 are also contemplated as being within the scope of the invention.

Method for Producing Molybdenum Metal Powder

A method 80 for production of the molybdenum metal powder 10 (described above) using apparatus 12 (described above) is disclosed herein and shown in FIG. 2. An embodiment of a method 80 for producing molybdenum metal powder 10 according to the present invention may be illustrated as steps in the flow chart shown in FIG. 2.

The method 80 generally begins with the ammonium molybdate precursor material 24 being introduced into the process tube 22, and moved through the each of the heating zones 16, 18, 20 of the furnace 14 (while inside the process tube 22). The process tube 22 may be rotating 58 and/or inclined 60 to facilitate movement and mixing of the ammonium molybdate precursor material 24 and the process gas 28. The process gas 28 flows through the process tube 22 in a direction that is opposite or counter-current (shown by arrow 32) to the direction that the ammonium molybdate precursor material 24 is moving through the process tube (shown by arrow 26). Having briefly described a general overview of the method 80, the method 80 will now be described in more detail.

The method begins by providing 82 a supply of ammonium molybdate precursor material 24. The ammonium molybdate precursor material 24 is described below in more detail. The ammonium molybdate precursor material 24 may then be introduced (i.e., fed) into the process tube 22. The feed rate of the ammonium molybdate precursor material 24 may be commensurate with the size of the equipment (i.e., furnace 14) used.

Figure 2:
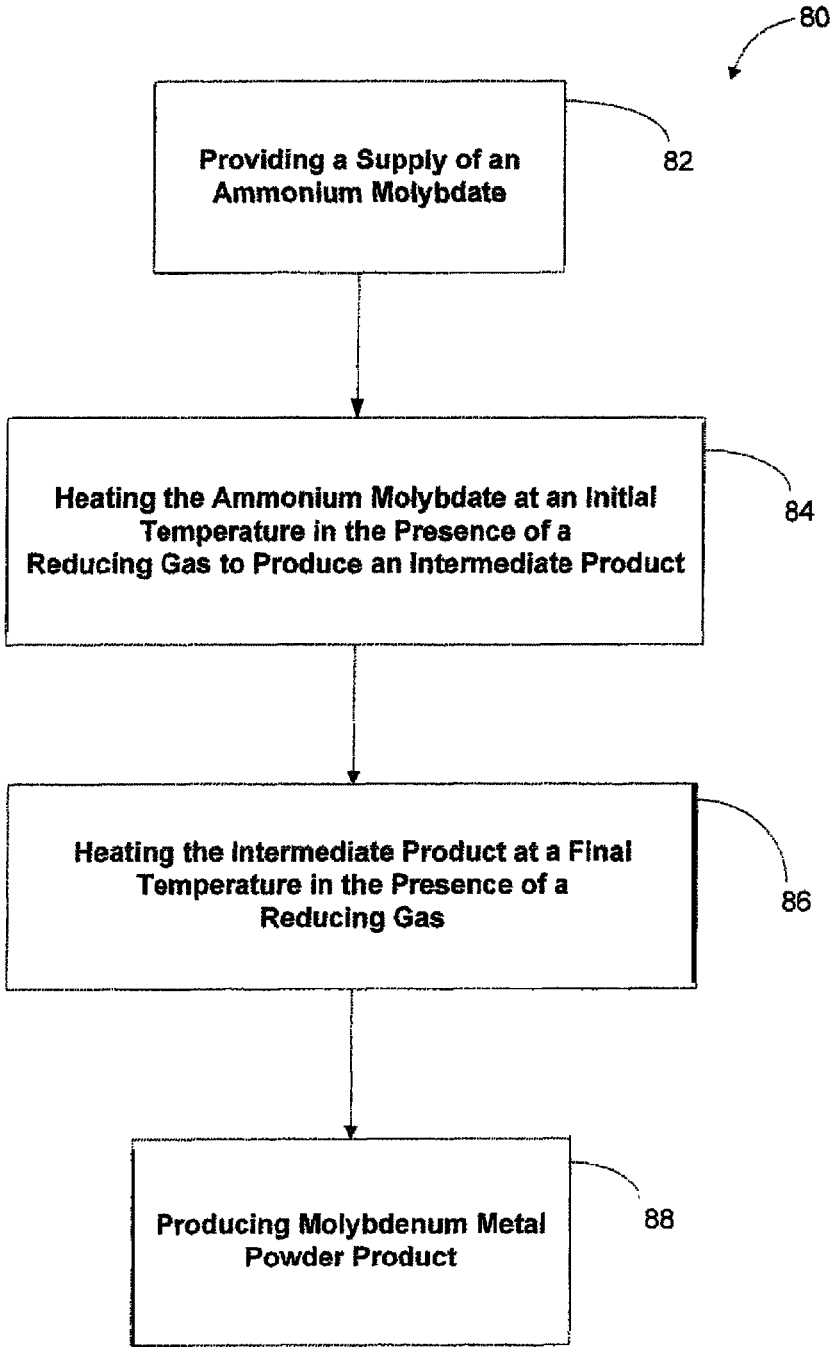
FIG. 2 is a flow chart illustrating an embodiment of a method for producing molybdenum metal powder according to the invention.

As shown in FIG. 2, the method 80 continues with heating 84 the ammonium molybdate precursor material 24 at an initial temperature in the presence of the process gas 28. As the ammonium molybdate precursor material 24 moves through the initial heating zone 16, it is mixed with the process gas 28 and reacts therewith to form an intermediate product 74 (shown in FIG. 1). The intermediate product 74 may be a mixture of unreacted ammonium molybdate precursor material 24, intermediate reaction products, and the molybdenum metal powder 10. The intermediate product 74 remains in the process tube 22 and continues to react with the process gas 28 as it is moved through the heating zones 16, 18, 20.

More specifically, the reaction in the initial heating zone 16 may be the reduction of the ammonium molybdate precursor material 24 by the reducing gas 30 (e.g., hydrogen gas) in the process gas 28 to form intermediate product 74. The reduction reaction may also produce water vapor and/or gaseous ammonia when the reducing gas 30 is hydrogen gas. The chemical reaction occurring in initial heating zone 16 between the ammonium molybdate precursor material 24 and reducing gas 30 is not fully known. However, it is generally believed that the chemical reaction occurring in initial zone 16 includes the reduction or fuming-off of 60%-70% of the gaseous ammonia, reducing to hydrogen gas and nitrogen gas, resulting in more available hydrogen gas, thus requiring less fresh hydrogen gas to be pumped into the process tube 22.

The temperature in the initial heating zone 16 may be maintained at a constant temperature of about 600° C. The ammonium molybdate precursor material 24 may be heated in the initial zone 16 for about 40 minutes. The temperature of the initial heating zone 16 may be maintained at a lower temperature than the temperatures of the intermediate 20 and final 18 heating zones because the reaction between the ammonium molybdate precursor material 24 and the reducing gas 30 in the initial heating zone 16 is an exothermic reaction. Specifically, heat is released during the reaction in the initial heating zone 16 and maintaining a temperature below 600° C. in the initial heating zone 16 helps to avoid fuming-off of molytrioxide ($MoO_3$).

The intermediate heating zone 20 may optionally be provided as a transition heating zone between the initial 16 and the final 18 heating zones. The temperature in the intermediate heating zone 20 is maintained at a higher temperature than the initial heating zone 16, but at a lower temperature than the final heating zone 18. The temperature in the intermediate heating zone 20 may be maintained at a constant temperature of about 770° C. The intermediate product 74 may be heated in the intermediate heating zone 20 for about 40 minutes.

The intermediate heating zone 20 provides a transition heating zone between the lower temperature of the initial heating zone 16 and the higher temperature of the final heating zone 18, providing better control of the size of the molybdenum metal power product 10. Generally, the reaction in the intermediate heating zone 20 is believed to involve a reduction reaction resulting in the formation or fuming-off of water vapor, gaseous ammonia, or gaseous oxygen, when the reducing gas 30 is hydrogen gas.

The method 80 continues with heating 86 the intermediate product 74 at a final temperature in the presence of reducing gas 30. As the intermediate product 74 moves into the final heating zone 18, it continues to be mixed with the process gas 28 (including reducing gas 30) and reacts therewith to form the molybdenum metal powder 10. It is believed that the reaction in the final heating zone 18 is a reduction reaction resulting in the formation of solid molybdenum metal powder (Mo) 10 and, water or gaseous hydrogen and nitrogen, when the reducing gas 30 is hydrogen gas.

The reaction between the intermediate product 74 and the reducing gas 30 in the final heating zone 18 is an endothermic reaction resulting in the production 88 of molybdenum metal powder product 10. Thus, the energy input of the final heating zone 18 may be adjusted accordingly to provide the additional heat required by the endothermic reaction in the final heating zone 18. The temperature in the final heating zone 18 may be maintained at approximately 950° C., more specifically, at a temperature of about 946° C. to about 975° C. The intermediate product 74 may be heated in the final heating zone 18 for about 40 minutes.

Generally, the surface-area-to-mass-ratios (as determined by BET analysis) of the molybdenum metal powder 10 decrease with increasing final heating zone 18 temperatures.

Generally, increasing the temperature of the final heating zone 18 increases agglomeration (i.e. "clumping") of the molybdenum metal powder 10 produced. While higher final heating zone 18 temperatures may be utilized, grinding or jet-milling of the molybdenum metal powder 10 may be necessary to break up the material for various subsequent sintering and other powder metallurgy applications.

The molybdenum metal powder 10 may also be screened to remove oversize particles from the product that may have agglomerated or "clumped" during the process. Whether the molybdenum metal powder 10 is screened will depend on design considerations such as, but not limited to, the ultimate use for the molybdenum metal powder 10, and the purity and/or particle size of the ammonium molybdate precursor material 24.

If the molybdenum metal powder 10 produced by the reactions described above is immediately introduced to an atmospheric environment while still hot (e.g., upon exiting final heating zone 18), it may react with oxygen in the atmosphere and reoxidize. Therefore, the molybdenum metal powder 10 may be moved through an enclosed cooling zone 48 after exiting final zone 18. The process gas 28 also flows through the cooling zone 48 so that the hot molybdenum metal powder 10 may be cooled in a reducing environment, lessening or eliminating reoxidation of the molybdenum metal powder 10 (e.g., to form $MoO_2$ and/or $MoO_3$). Additionally, the cooling zone 48 may also be provided to cool molybdenum metal powder 10 for handling purposes.

The above reactions may occur in each of the heating zones 16, 18, 20 over a total time period of about two hours. It is understood that some molybdenum metal powder 10 may be formed in the initial heating zone 16 and/or the intermediate heating zone 20. Likewise, some unreacted ammonium molybdate precursor material 24 may be introduced into the intermediate heating zone 20 and/or the final heating zone 18. Additionally, some reactions may still occur even in the cooling zone 46.

Having discussed the reactions in the various portions of process tube 22 in furnace 14, it should be noted that optimum conversions of the ammonium molybdate precursor material 24 to the molybdenum metal powder 10 were observed to occur when the process parameters were set to values in the ranges shown in Table 1 below.

TABLE 1

| PARAMETER | SETTING |
|---|---|
| Process Tube Incline | 0.25% |
| Process Tube Rotation Rate | 3.0 revolutions per minute |
| Temperature | |
| Initial Zone | about 600° C. |
| Intermediate Zone | about 750° C. |
| Final Zone | about 950° C.-1025° C. |
| Time | |
| Initial Zone | about 40 minutes |
| Intermediate Zone | about 40 minutes |
| Final Zone | about 40 minutes |
| Process Gas Flow Rate | 60 to 120 cubic feet per hour |

As will become apparent after studying Examples 1-14 below, the process parameters outlined in Table 1 and discussed above may be altered to optimize the characteristics of the desired molybdenum metal powder 10. Similarly, these parameters may be altered in combination with the selection of the ammonium molybdate precursor material 24 to further optimize the desired characteristics of the molybdenum metal powder 10. The characteristics of the desired molybdenum metal powder 10 will depend on design considerations such as, but not limited to, the ultimate use for the molybdenum metal powder 10, the purity and/or particle size of the ammonium molybdate precursor material 24, etc.

EXAMPLES 1 & 2

In these Examples, the ammonium molybdate precursor material 24 was ammonium heptamolybdate (AHM). The particles of AHM used as the ammonium molybdate precursor material 24 in this example are produced by and are commercially available from the Climax Molybdenum Company (Fort Madison, Iowa).

The following equipment was used for these examples: loss-in-weight feed system 52 available from Brabender as model no. H31-FW33/50, commercially available from C.W. Brabender Instruments, Inc. (South Hackensack, N.J.); and rotating tube furnace 14 available from Harper International Corporation as model no. HOU-6D60-RTA-28-F (Lancaster, N.Y.). The rotating tube furnace 14 comprised independently controlled 50.8 cm (20 in) long heating zones 16, 18, 20 with a 305 cm (120 in) HT alloy tube 22 extending through each of the heating zones 16, 18, 20 thereof. Accordingly, a total of 152 cm (60 in) of heating and 152 cm (60 in) of cooling were provided in this Example.

In these Examples, the ammonium molybdate precursor material 24 was fed, using the loss-in-weight feed system 52, into the process tube 22 of the rotating tube furnace 14. The process tube 22 was rotated 58 and inclined 60 (as specified in Table 2, below) to facilitate movement of the ammonium molybdate precursor material 24 through the rotating tube furnace 14, and to facilitate mixing of the ammonium molybdate precursor material 24 with process gas 28. The process gas 28 was introduced through the process tube 22 in a direction opposite or counter-current 32 to the direction that the ammonium molybdate precursor material 24 was moving through the process tube 22. In these Examples, the process gas 28 comprised hydrogen gas as the reducing gas 30, and nitrogen gas as the inert carrier gas 46. The discharge gas was bubbled through a water scrubber (not shown) to maintain the interior of the furnace 14 at approximately 11.4 cm (4.5 in) of water pressure. The rotating tube furnace 14 parameters were set to the values shown in Table 2 below.

TABLE 2

| PARAMETER | SETTING |
|---|---|
| Precursor Feed Rate | 5 to 7 grams per minute |
| Process Tube Incline | 0.25% |
| Process Tube Rotation | 3.0 revolutions per minute |
| Temperature Set Points | |
| Initial Zone | 600° C. |
| Intermediate Zone | 770° C. |
| Final Zone | 946° C.-975° C. |
| Time | |
| Initial Zone | 40 minutes |
| Intermediate Zone | 40 minutes |
| Final Zone | 40 minutes |
| Process gas Rate | 80 cubic feet per hour |

Molybdenum metal 10 produced in Examples 1 and 2 is shown in FIGS. 3-5, and discussed above with respect thereto. Specifically, the molybdenum metal powder 10 produced according to these Examples is distinguished by its surface-area-to-mass-ratio in combination with its particle size and flowability. Specifically, the molybdenum metal powder 10 produced according to these Examples has surface-area-to-mass-ratios of 2.364 $m^2$/gm for Example 1, and 2.027 $m^2$/gm for Example 2, as determined by BET analysis. The molybdenum metal powder 10 produced according to these Examples has flowability of 63 s/50 g for Example 1 and 58 s/50 g for Example 2. The results obtained and described above for Examples 1 and 2 are also detailed in Table 3 below.

TABLE 3

| Example/ Final Zone | Surface-area-to-mass-ratio | Flowability | Final Weight % | Particle Size Distribution by Standard Sieve Analysis | |
|---|---|---|---|---|---|
| Temp. (° C.) | ($m^2$/gm) | (s/50 g) | Oxygen | +100 | −325 |
| 1/946° C. | 2.364 $m^2$/gm | 63 s/50 g | 0.219% | 39.5% | 24.8% |
| 2/975° C. | 2.027 $m^2$/gm | 58 s/50 g | 0.171% | 48.9% | 17.8% |

Example 1 results (listed above in Table 3) were obtained by averaging ten separate test runs. The detailed test run data for Example 1 is listed in Table 4 below. The final weight percent of oxygen in Example 1 was calculated by mathematically averaging each of the ten test runs. The surface-area-to-mass-ratio, flowability, and particle size distribution results were obtained after combining and testing the molybdenum powder products from the ten separate test runs.

Example 2 results (listed above in Table 3) were obtained by averaging sixteen separate test runs. The detailed test run data for Example 2 is also listed in Table 4 below. The final weight percent of oxygen in Example 2 was calculated by mathematically averaging each of the sixteen test runs. The surface-area-to-mass-ratio, flowability, and particle size distribution results were obtained after combining and testing the molybdenum powder products from the sixteen separate test runs.

TABLE 4

| Ex. # | Run # | Feed In (kg) | Feed In (g/min.) | Tube Incline % | Tube Rotation (rpm) | Initial Zone Temp. ° C. | Intermediate Zone Temp. ° C. | Final Zone Temp. ° C. | Hydrogen Gas Flow (ft3/hr) | Net Weight (kg) | Final Weight % Oxygen |
|---|---|---|---|---|---|---|---|---|---|---|---|
| Ex. 1 | 1 | 2.415 | 8.05 | 0.25 | 3.00 | 600 | 770 | 946 | 80 | 0.900 | 0.190 |
| | 2 | 1.348 | 5.62 | 0.25 | 3.00 | 600 | 770 | 946 | 80 | 0.760 | 0.190 |
| | 3 | 1.494 | 6.22 | 0.25 | 3.00 | 600 | 770 | 946 | 80 | 0.760 | 0.170 |
| | 4 | 1.425 | 5.94 | 0.25 | 3.00 | 600 | 770 | 946 | 80 | 0.880 | 0.190 |
| | 5 | 1.689 | 7.04 | 0.25 | 3.00 | 600 | 770 | 946 | 80 | 0.560 | 0.280 |
| | 6 | 2.725 | 11.35 | 0.25 | 3.00 | 600 | 770 | 946 | 80 | 0.760 | 0.240 |
| | 7 | 1.492 | 6.22 | 0.25 | 3.00 | 600 | 770 | 946 | 80 | 0.580 | 0.250 |
| | 8 | 0.424 | 1.77 | 0.25 | 3.00 | 600 | 770 | 946 | 80 | 0.360 | 0.200 |
| | 9 | 1.752 | 7.30 | 0.25 | 3.00 | 600 | 770 | 946 | 80 | 1.140 | 0.260 |
| | 10 | 0.864 | 3.60 | 0.25 | 3.00 | 600 | 770 | 946 | 80 | 0.770 | 0.220 |
| Ex. 2 | 11 | 0.715 | 2.98 | 0.25 | 3.00 | 600 | 770 | 975 | 80 | 0.700 | 0.150 |
| | 12 | 2.575 | 10.73 | 0.25 | 3.00 | 600 | 770 | 975 | 80 | 0.600 | 0.220 |
| | 13 | 1.573 | 6.55 | 0.25 | 3.00 | 600 | 770 | 975 | 80 | 0.640 | 0.230 |
| | 14 | 1.376 | 5.73 | 0.25 | 3.00 | 600 | 770 | 975 | 80 | 0.640 | 0.200 |
| | 15 | 1.11 | 4.62 | 0.25 | 3.00 | 600 | 770 | 975 | 80 | 0.700 | 0.220 |
| | 16 | 1.53 | 6.37 | 0.25 | 3.00 | 600 | 770 | 975 | 80 | 0.720 | 0.140 |
| | 17 | 1.766 | 7.36 | 0.25 | 3.00 | 600 | 770 | 975 | 80 | 0.680 | 0.160 |
| | 18 | 2.038 | 8.49 | 0.25 | 3.00 | 600 | 770 | 975 | 80 | 0.780 | 0.160 |
| | 19 | 1.111 | 4.63 | 0.25 | 3.00 | 600 | 770 | 975 | 80 | 0.580 | 0.160 |
| | 20 | 1.46 | 6.08 | 0.25 | 3.00 | 600 | 770 | 975 | 80 | 0.760 | 0.200 |
| | 21 | 1.213 | 5.05 | 0.25 | 3.00 | 600 | 770 | 975 | 80 | 0.720 | 0.180 |
| | 22 | 1.443 | 6.01 | 0.25 | 3.00 | 600 | 770 | 975 | 80 | 1.060 | 0.150 |
| | 23 | 1.007 | 4.20 | 0.25 | 3.00 | 600 | 770 | 975 | 80 | 0.516 | 0.140 |
| | 24 | 1.848 | 7.70 | 0.25 | 3.00 | 600 | 770 | 975 | 80 | 0.700 | 0.150 |
| | 25 | 1.234 | 5.14 | 0.25 | 3.00 | 600 | 770 | 975 | 80 | 0.660 | 0.140 |
| | 26 | 0.444 | 1.85 | 0.25 | 3.00 | 600 | 770 | 975 | 80 | 0.620 | 0.140 |
| Ex. 3 | 27 | 2.789 | 11.60 | 0.25 | 3.00 | 600 | 770 | 950 | 80 | 1.880 | 0.278 |
| Ex. 4 | 28 | 4.192 | 14.00 | 0.25 | 3.00 | 600 | 770 | 1000 | 80 | 1.340 | 0.168 |
| | 29 | 2.709 | 15.00 | 0.25 | 3.00 | 600 | 770 | 1000 | 80 | 1.400 | 0.160 |
| | 30 | 3.21 | 13.40 | 0.25 | 3.00 | 600 | 770 | 1000 | 80 | 1.380 | 0.170 |
| | 31 | 2.545 | 10.60 | 0.25 | 3.00 | 600 | 770 | 1000 | 80 | 1.360 | 0.123 |
| | 32 | 2.617 | 10.90 | 0.25 | 3.00 | 600 | 770 | 1000 | 80 | 1.260 | 0.117 |
| | 33 | 3.672 | 15.30 | 0.25 | 3.00 | 600 | 770 | 1000 | 80 | 1.200 | 0.173 |
| Ex. 5 | 34 | 2.776 | 11.60 | 0.25 | 3.00 | 600 | 770 | 1025 | 95 | 0.900 | 0.179 |
| | 35 | 2.949 | 12.30 | 0.25 | 3.00 | 600 | 770 | 1025 | 95 | 1.720 | 0.160 |
| | 36 | 3.289 | 13.70 | 0.25 | 3.00 | 600 | 770 | 1025 | 95 | 0.980 | 0.181 |
| | 37 | 2.329 | 9.70 | 0.25 | 3.00 | 600 | 770 | 1025 | 95 | 1.080 | 0.049 |
| | 38 | 2.19 | 9.10 | 0.25 | 3.00 | 600 | 770 | 1025 | 95 | 0.906 | 0.125 |
| Ex. 6 | 39 | 3.187 | 13.30 | 0.25 | 3.00 | 600 | 770 | 950 | 95 | 0.800 | 0.084 |
| | 40 | 3.048 | 12.70 | 0.25 | 3.00 | 600 | 770 | 950 | 95 | 0.676 | 0.203 |
| | 41 | 2.503 | 10.40 | 0.25 | 3.00 | 600 | 770 | 950 | 95 | 1.836 | 0.185 |
| | 42 | 2.266 | 9.40 | 0.25 | 3.00 | 600 | 770 | 950 | 95 | 1.112 | 0.194 |
| | 43 | −0.01 | −0.30 | 0.25 | 3.00 | 600 | 770 | 950 | 95 | 0.652 | 0.085 |

EXAMPLES 3-6

In Examples 3-6, the ammonium molybdate precursor material 24 was ammonium heptamolybdate (AHM). Examples 3-6 used the same ammonium molybdate precursor material 24, the same equipment, and the same process parameter settings as previously described above in detail in Examples 1 and 2. Examples 3-6 varied only the temperature of the final zone. The results obtained for Examples 3-6 are shown in Table 5 below.

TABLE 5

| Example/ Final Zone | Surface-area-to-mass-ratio | Final Weight % | Particle Size Distribution by Standard Sieve Analysis | |
|---|---|---|---|---|
| Temp. (° C.) | ($m^2$/gm) | Oxygen | +100 | −325 |
| 3/950° C. | 2.328 $m^2$/gm | 0.278% | 37.1% | 21.6% |
| 4/1000° C. | 1.442 $m^2$/gm | 0.152% | 36.1% | 23.8% |
| 5/1025° C. | 1.296 $m^2$/gm | 0.139% | 33.7% | 24.2% |
| 6/950° C. | 1.686 $m^2$/gm | 0.150% | 34.6% | 27.8% |

Example 3 results (listed above in Table 5) were obtained from one separate test run. The detailed test run data for Example 3 is listed in Table 4 above. The final weight percent of oxygen, surface-area-to-mass-ratio, and particle size distribution results were obtained after testing the run data from the one test run.

Example 4 results (listed above in Table 5) were obtained by averaging six separate test runs. The detailed test run data for Example 4 is also listed in Table 4 above. The final weight percent of oxygen in Example 4 was calculated by mathematically averaging each of the six test runs. The surface-area-to-mass-ratio and particle size distribution results were obtained after combining and testing the molybdenum powder products from the six separate test runs.

Example 5 results (listed above in Table 5) were obtained by averaging five separate test runs. The detailed test run data for Example 5 is also listed in Table 4 above. The final weight percent of oxygen in Example 5 was calculated by mathematically averaging each of the five test runs. The surface-area-to-mass-ratio and particle size distribution results were obtained after combining and testing the molybdenum powder products from the five separate test runs.

Example 6 results (listed above in Table 5) were obtained by averaging five separate test runs. The detailed test run data for Example 6 is also listed in Table 4 above. The final weight percent of oxygen in Example 6 was calculated by mathematically averaging each of the five test runs. The surface-area-to-mass-ratio and particle size distribution results were obtained after combining and testing the molybdenum powder products from the five separate test runs.

EXAMPLES 7-12

In Examples 7-12, the ammonium molybdate precursor material 24 was ammonium heptamolybdate (AHM). Examples 7-12 used the same ammonium molybdate precursor material 24, the same equipment, and the same process parameter settings as previously described above in detail in Examples 1 and 2. Examples 7-12 varied in the temperatures of the intermediate and final zones. The temperatures of the intermediate and final zones and the results obtained for Examples 7-12 are shown in Table 6 below.

TABLE 6

| Example/ Intermediate Zone Temp./ Final Zone | Surface-area-to-mass-ratio | Flowability | Final Weight % | Particle Size Distribution by Standard Sieve Analysis | |
|---|---|---|---|---|---|
| Temp. (° C.) | ($m^2$/gm) | (s/50 g) | Oxygen | +100 | −325 |
| 7/ 770° C./ 950° C. | 1.79 $m^2$/gm | 52 s/50 g | 0.270% | 43.8% | 16.7% |
| 8/ 760° C./ 940° C. | 1.93 $m^2$/gm | 51 s/50 g | 0.290% | 51.1% | 13.7% |
| 9/ 750° C./ 930° C. | 1.95 $m^2$/gm | 57 s/50 g | 0.284% | 49.5% | 14.8% |
| 10/ 740° C./ 920° C. | 2.17 $m^2$/gm | 59 s/50 g | 0.275% | 43.8% | 17.2% |
| 11/ 730° C./ 910° C. | 2.95 $m^2$/gm | 61 s/50 g | 0.348% | 45.6% | 16.8% |
| 12/ 770° C./ 950° C. | 1.90 $m^2$/gm | 64 s/50 g | 0.242% | 50.3% | 12.5% |

Example 7 results (listed above in Table 6) were obtained by averaging nine separate test runs. The final weight percent of oxygen in Example 7 was calculated by mathematically averaging each of the nine test runs. The surface-area-to-mass-ratio, flowability, and particle size distribution results were obtained after combining and testing the molybdenum powder products from the nine separate test runs.

Example 8 results (listed above in Table 6) were obtained by averaging six separate test runs. The final weight percent of oxygen in Example 7 was calculated by mathematically averaging each of the six test runs. The surface-area-to-mass-ratio, flowability, and particle size distribution results were obtained after combining and testing the molybdenum powder products from the six separate test runs.

Example 9 results (listed above in Table 6) were obtained by averaging eight separate test runs. The final weight percent of oxygen in Example 7 was calculated by mathematically averaging each of the eight test runs. The surface-area-to-mass-ratio, flowability, and particle size distribution results were obtained after combining and testing the molybdenum powder products from the eight separate test runs.

Example 10 results (listed above in Table 6) were obtained by averaging seventeen separate test runs. The final weight percent of oxygen in Example 7 was calculated by mathematically averaging each of the seventeen test runs. The surface-area-to-mass-ratio, flowability, and particle size distribution results were obtained after combining and testing the molybdenum powder products from the seventeen separate test runs.

Example 11 results (listed above in Table 6) were obtained by averaging six separate test runs. The final weight percent of oxygen in Example 7 was calculated by mathematically averaging each of the six test runs. The surface-area-to-mass-ratio, flowability, and particle size distribution results were obtained after combining and testing the molybdenum powder products from the six separate test runs.

Example 12 results (listed above in Table 6) were obtained by averaging sixteen separate test runs. The final weight percent of oxygen in Example 7 was calculated by mathematically averaging each of the sixteen test runs. The surface-area-to-mass-ratio, flowability, and particle size distribution results were obtained after combining and testing the molybdenum powder products from the sixteen separate test runs.

EXAMPLE 13

In Example 13, the ammonium molybdate precursor material 24 was ammonium dimolybdate (ADM). Example 13 used the same equipment and process parameter settings as previously described above in detail in Examples 1 and 2, except that the temperature of the initial, intermediate, and final heating zones 16, 18, 20 was kept at 600° C. The results obtained for Example 13 are shown in Table 7 below.

TABLE 7

| Example | Surface-area-to-mass-ratio ($m^2$/gm) | Flowability (s/50 g) | Final Weight % Oxygen | Particle Size Distribution by Standard Sieve Analysis +100 | −325 |
|---|---|---|---|---|---|
| 13 | 1.58 $m^2$/gm | 78 s/50 g | 1.568% | 52.2% | 8.9% |

Example 13 results (listed above in Table 7) were obtained by averaging four separate test runs. The final weight percent of oxygen in Example 13 was calculated by mathematically averaging each of the four test runs. The surface-area-to-mass-ratio, flowability, and particle size distribution results were obtained after combining and testing the molybdenum powder 10 products from the four separate test runs.

EXAMPLE 14

In Example 14, the ammonium molybdate precursor material 24 was ammonium octamolybdate (AOM). Example 14 used the same equipment and process parameter settings as previously described above in detail in Examples 1 and 2, except that the temperatures of the intermediate and final heating zones 18, 20 were varied. In Example 14 the intermediate heating zone 18 was set between 750° C.-800° C. and the final heating zone 20 was set between 900° C.-1000° C. The results obtained for Example 14 are shown in Table 8 below.

TABLE 8

| Example | Surface-area-to-mass-ratio ($m^2$/gm) | Flowability (s/50 g) | Final Weight % Oxygen | Particle Size Distribution by Standard Sieve Analysis +100 | −325 |
|---|---|---|---|---|---|
| 14 | 2.00 $m^2$/gm | >80 s/50 g (No Flow) | 0.502% | 61.4% | 8.6% |

Example 14 results (listed above in Table 8) were obtained by averaging eleven separate test runs. The final weight percent of oxygen in Example 14 was calculated by mathematically averaging each of the eleven test runs. The surface-area-to-mass-ratio, flowability, and particle size distribution results were obtained after combining and testing the molybdenum powder products from the eleven separate test runs.

As will be understood by those skilled in the art after reviewing the above Examples, the selection of an ammonium molybdate precursor material 24 will depend on the intended use for the molybdenum metal power 10. As previously discussed, the selection of the ammonium molybdate precursor material 24 may depend on various design considerations, including but not limited to, the desired characteristics of the molybdenum metal powder 10 (e.g., surface-area-to-mass-ratio, size, flowability, sintering ability, sintering temperature, final weight percent of oxygen, purity, etc.).

It is readily apparent that the molybdenum metal powder 10 discussed herein has a relatively large surface-area-to-mass-ratio in combination with large particle size. Likewise, it is apparent that apparatus 12 and methods 80 for production of molybdenum metal powder 10 discussed herein may be used to produce molybdenum metal powder 10. Consequently, the claimed invention represents an important development in molybdenum metal powder technology.

EXAMPLES 15-18

In Examples 15-18, the ammonium molybdate precursor material 24 was AHM. The particles of AHM used as ammonium molybdate precursor material 24 in this example are produced by and are commercially available from Climax Molybdenum Company (Ft. Madison, Iowa).

The equipment used in Examples 15-18 was the same feed system 52 and rotating tube furnace 14 as used in the Examples set forth above. Ammonium molybdate precursor material 24 was fed, using the loss-in-weight feed system 52, into the process tube 22 of the rotating tube furnace 14. The process tube 22 was rotated 58 and inclined 60 (as specified in Table 2 above) to facilitate movement of the ammonium molybdate precursor material 24 through the rotating tube furnace 14, and to facilitate mixing of the ammonium molybdate precursor material 24 with the process gas 28. The process gas 28 was introduced through the process tube 22 counter-current 32 to the direction that the ammonium molybdate precursor material 24 was moving through the process tube 22. In Examples 15-18, the process gas 28 comprised hydrogen gas as the reducing gas 30, and nitrogen gas as the inert carrier gas 46. The discharge gas was bubbled through a water scrubber (not shown) to maintain the interior of the furnace 14 at approximately 11.4 cm (4.5 in) of water pressure.

For Examples 15-17, the rotating tube furnace 14 parameters were set to the values shown in Table 2 above, except the process gas 28 rate was about 95 cubic feet per hour.

For Example 18, the rotating tube furnace 14 parameters were set to the values shown in Table 2 above, except the intermediate heating zone 18 temperature was about 760° C., the final heating zone 20 temperature was about 925° C. and the process gas 28 rate was about 40 cubic feet per hour.

The characteristics for molybdenum metal powder 10 produced according to Examples 15-18 are shown in Table 9 below. Molybdenum powder 10 produced according to Examples 15-18 is distinguished by it surface-area-to-mass ratio in combination with its particle size and flowability. The surface-area-to-mass ratio for Example 15 was 3.0 $m^2$/g; for Example 16, 1.9 $m^2$/g; for Example 17, 3.6 $m^2$/g; and, for Example 18, 2.5 $m^2$/g. Apparent densities for Examples 15, 16 and 18 were determined using a Hall density apparatus. Apparent density for Example 17 was determined using a Scott Volumeter. Characteristics of other examples of molybdenum metal powder 10 are described in Tables 10-15 below and identified as PM.

TABLE 9

| Example | % $N_2$ | % $O_2$ | Density g/cm$^3$ | Tap g/cm$^3$ | Hall Flow s/50 g | Particle Size 28 | +100 | −100/+140 | −140/+200 | −200/+325 | −325 | Surface Area BET (m$^2$/g) |
|---|---|---|---|---|---|---|---|---|---|---|---|---|
| 15 | 0.240 | 0.740 | 1.45 (Hall) | 1.84 | 58.2 | 0 | 55.5 | 16.3 | 8.4 | 9.0 | 10.7 | 3.0 |
| 16 | 0.061 | 0.823 | 1.46 (Hall) | 1.92 | 63.0 | 0 | 46.5 | 14.3 | 9.3 | 11.4 | 18.5 | 1.9 |
| 17 | | 0.447 | 1.4 (Scott) | 1.7 | 55.0 | 0 | 52.7 | 17.6 | 10.3 | 9.6 | 9.8 | 3.6 |
| 18 | 0.363 | 10.9 | 1.33 (Hall) | 1.69 | 66.3 | 0 | 58.9 | 15.4 | 7.9 | 7.9 | 9.9 | 2.5 |

Densified Molybdenum Metal Powder

Various types of high density molybdenum metal powder may be produced in accordance with the teachings provided herein from a precursor material comprising molybdenum metal powder 10, the characteristics of which are described above. One type of high density molybdenum metal powder is referred to herein as "low temperature densified molybdenum metal powder 100." A second type of high density molybdenum metal powder may be referred to herein as "plasma densified molybdenum metal powder 200." While both types of molybdenum metal powders are similar because they represent molybdenum metal powders with higher densities than that of molybdenum metal powder 10 described above, they differ as to the processes used to produce them, as well as in certain of their physical characteristics as will be described in greater detail herein.

Low Temperature Densified Molybdenum Metal Powder

Figure 14:
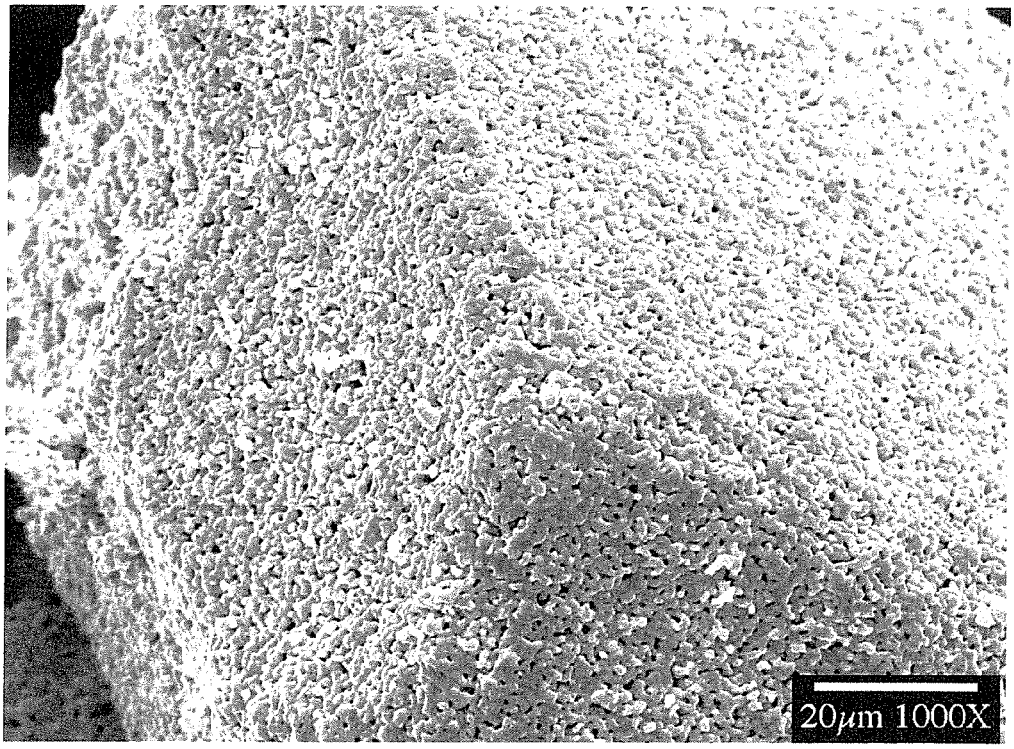
FIG. 14 is a scanning electron microscope image (20 μm 1000×) of low temperature densified molybdenum metal powder such as may be produced according to one embodiment of the present invention wherein the molybdenum metal powder precursor material is densified at a temperature of about 1065° C.
Figure 15:
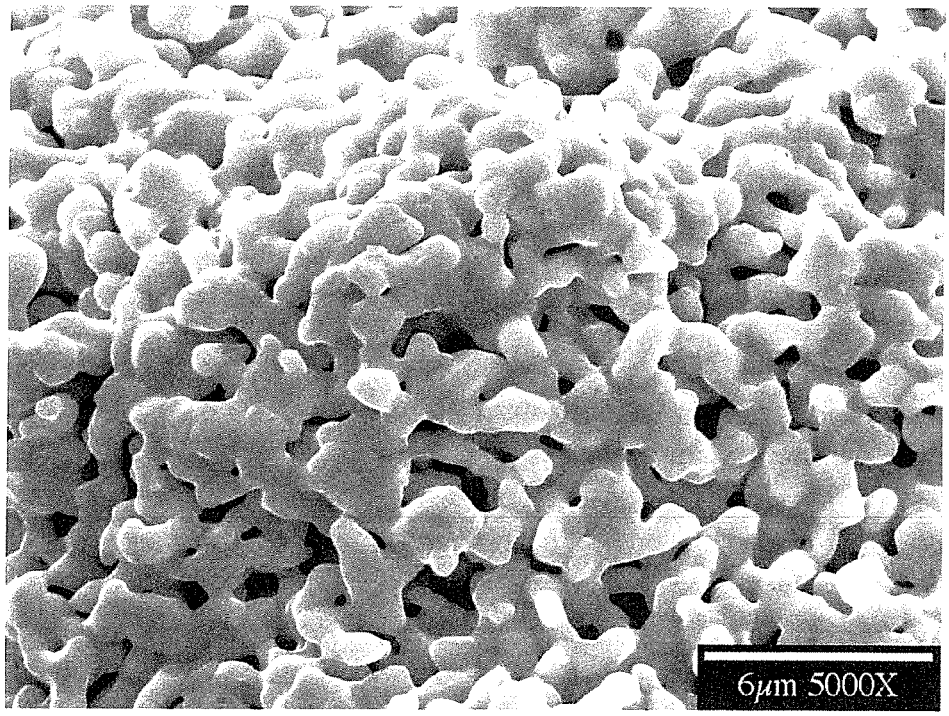
FIG. 15 is a scanning electron microscope image (6 μm 5000×) of low temperature densified molybdenum metal powder such as may be produced according to one embodiment of the present invention wherein the molybdenum metal powder precursor material is densified at a temperature of about 1065° C.
Figure 16:
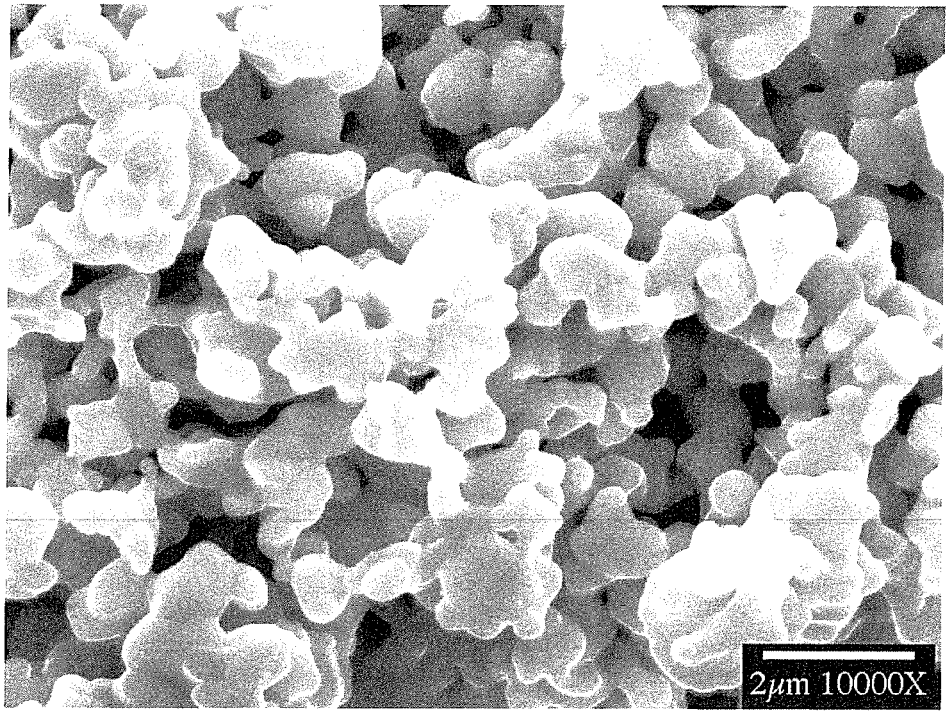
FIG. 16 is a scanning electron microscope image (2 μm 10,000×) of low temperature densified molybdenum metal powder such as may be produced according to one embodiment of the present invention wherein the molybdenum metal powder precursor material is densified at a temperature of about 1065° C.
Figure 17:
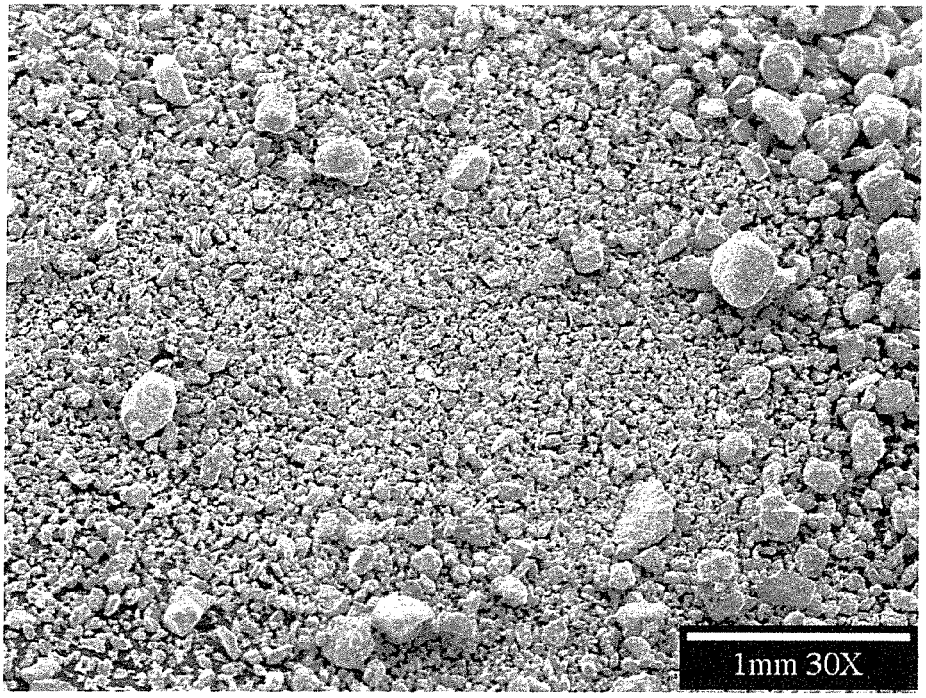
FIG. 17 is a scanning electron microscope image (1 mm 30×) of low temperature densified molybdenum metal powder such as may be produced according to one embodiment of the present invention wherein the molybdenum metal powder precursor material is densified at a temperature of about 1300° C.
Figure 18:
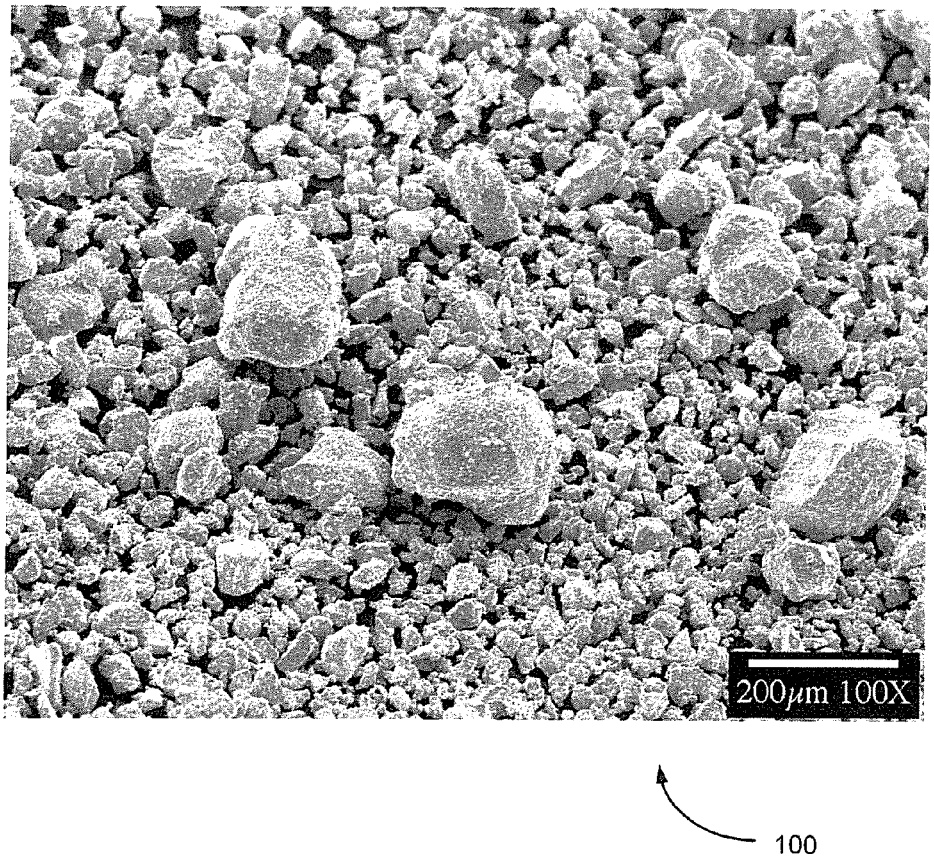
FIG. 18 is a scanning electron microscope image (200 μm 100×) of low temperature densified molybdenum metal powder such as may be produced according to one embodiment of the present invention wherein the molybdenum metal powder precursor material is densified at a temperature of about 1300° C.
Figure 19:
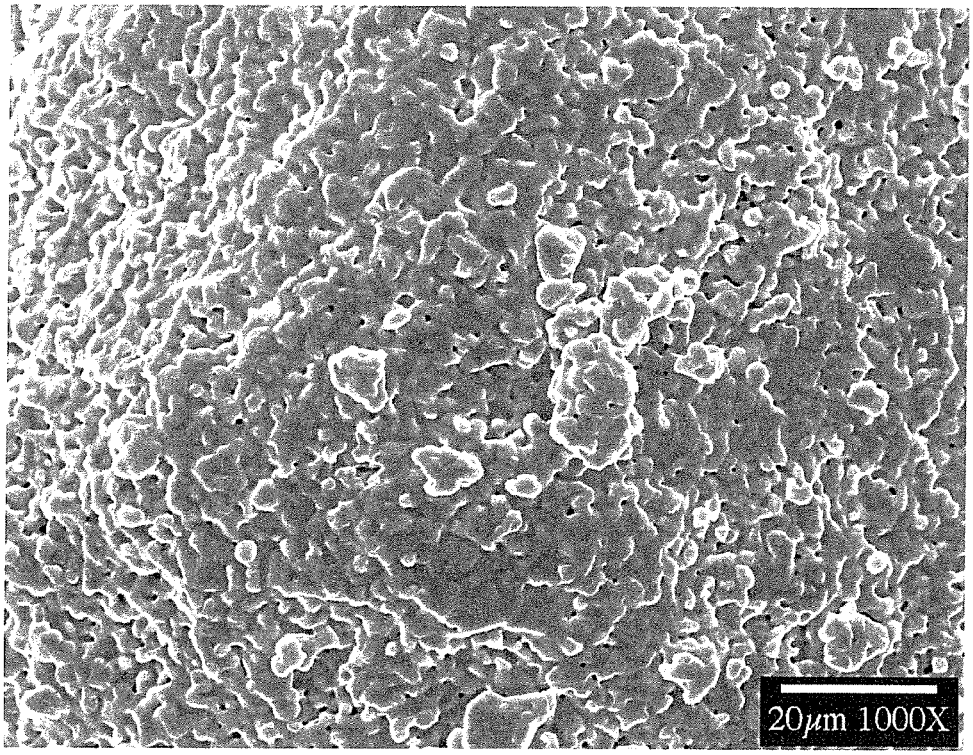
FIG. 19 is a scanning electron microscope image (20 μm 1000×) of low temperature densified molybdenum metal powder such as may be produced according to one embodiment of the present invention wherein the molybdenum metal powder precursor material is densified at a temperature of about 1300° C.
Figure 20:
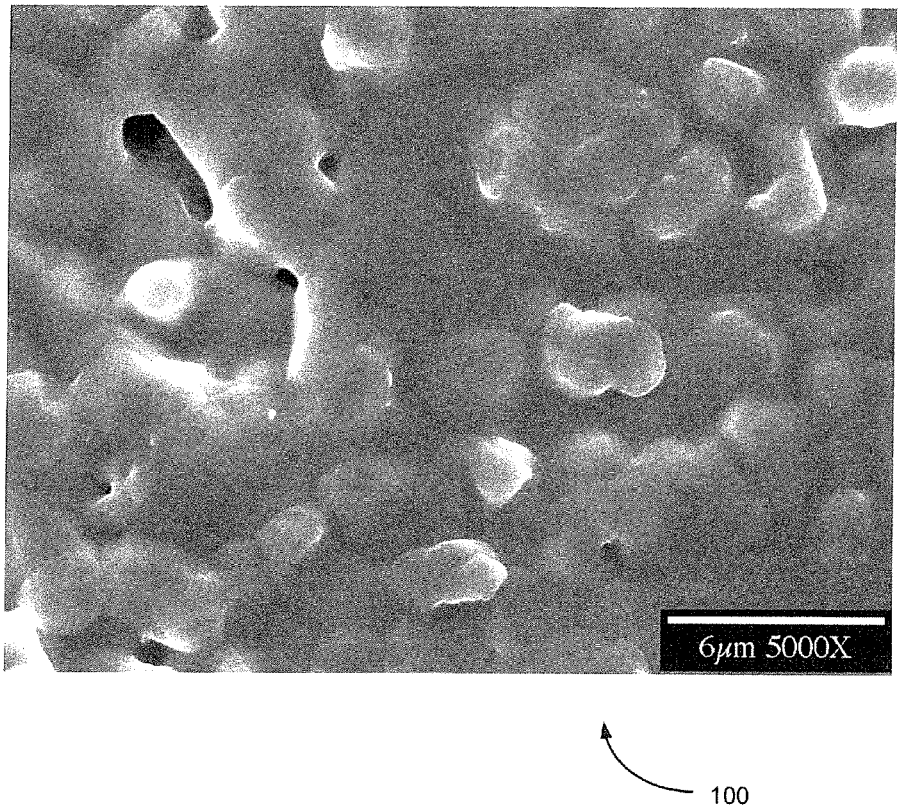
FIG. 20 is a scanning electron microscope image (6 μm 5000×) of low temperature densified molybdenum metal powder such as may be produced according to one embodiment of the present invention wherein the molybdenum metal powder precursor material is densified at a temperature of about 1300° C.
Figure 21:
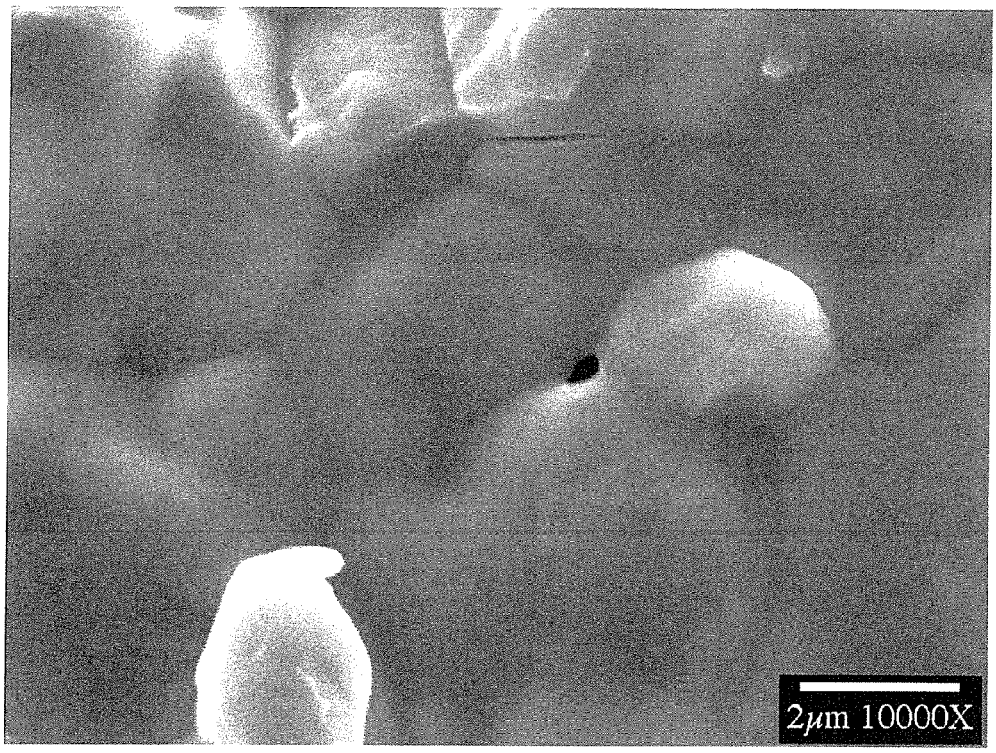
FIG. 21 is a scanning electron microscope image (2 μm 10,000×) of low temperature densified molybdenum metal powder such as may be produced according to one embodiment of the present invention wherein the molybdenum metal powder precursor material is densified at a temperature of about 1300° C.
Figure 22:
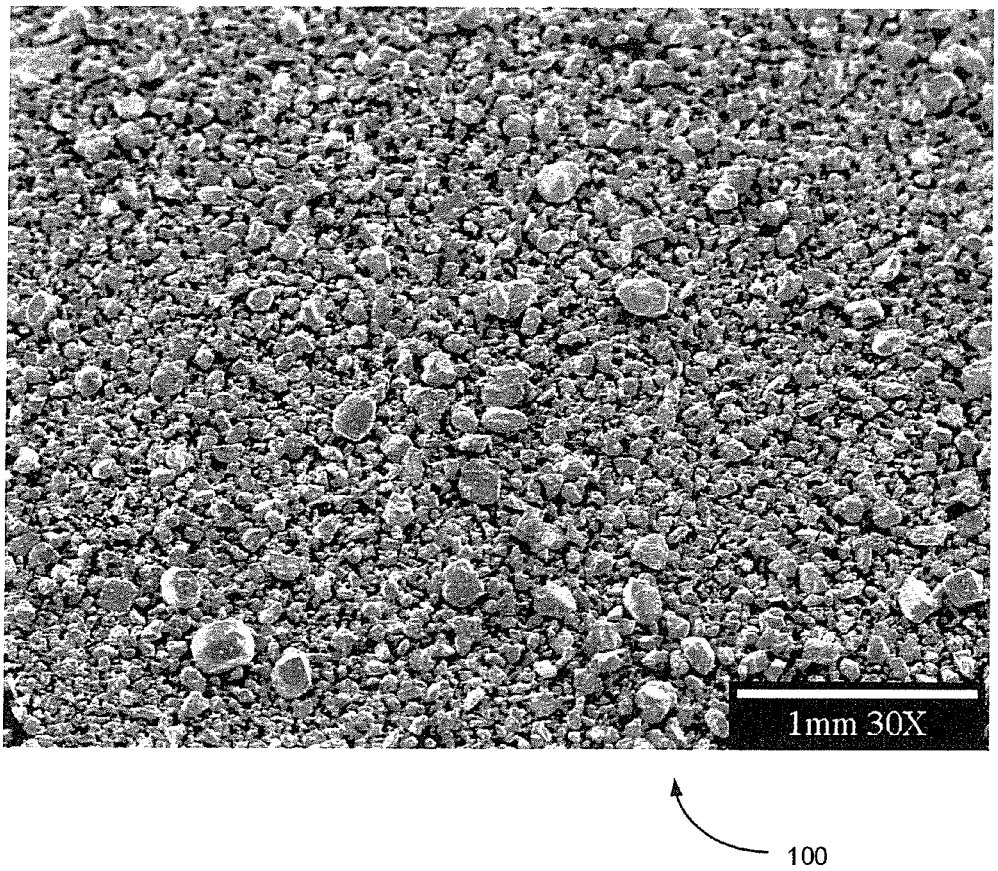
FIG. 22 is a scanning electron microscope image (1 mm 30×) of low temperature densified molybdenum metal powder such as may be produced according to one embodiment of the present invention wherein the molybdenum metal powder precursor material is densified at a temperature of about 1500° C.
Figure 23:
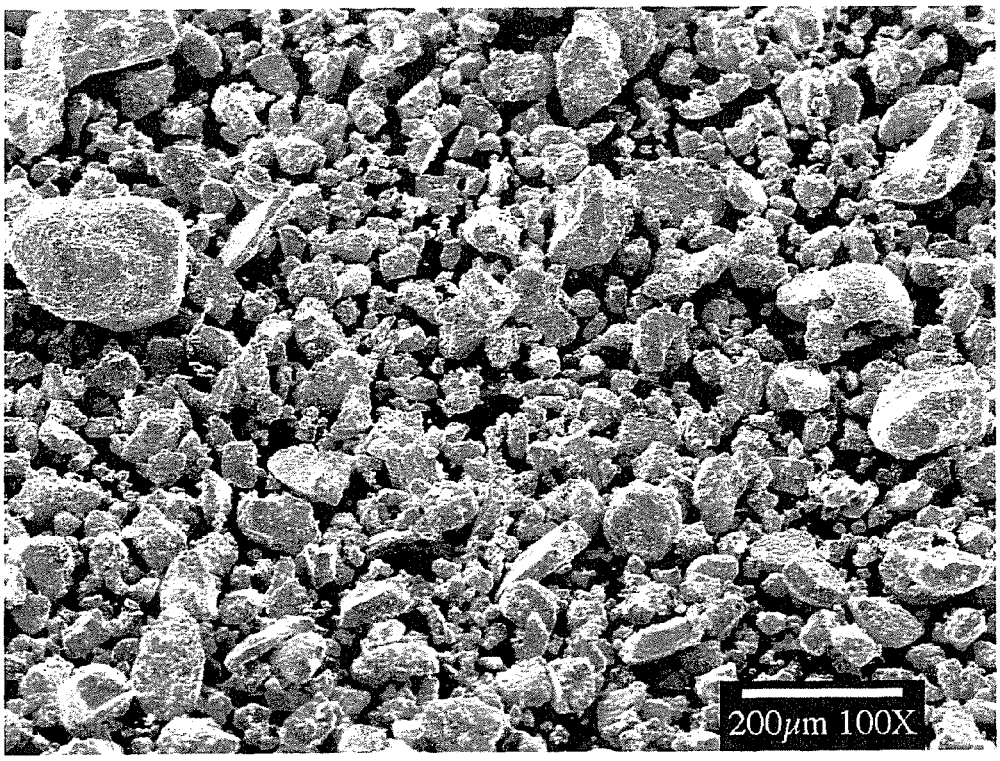
FIG. 23 is a scanning electron microscope image (200 μm 100×) of low temperature densified molybdenum metal powder such as may be produced according to one embodiment of the present invention wherein the molybdenum metal powder precursor material is densified at a temperature of about 1500° C.
Figure 24:
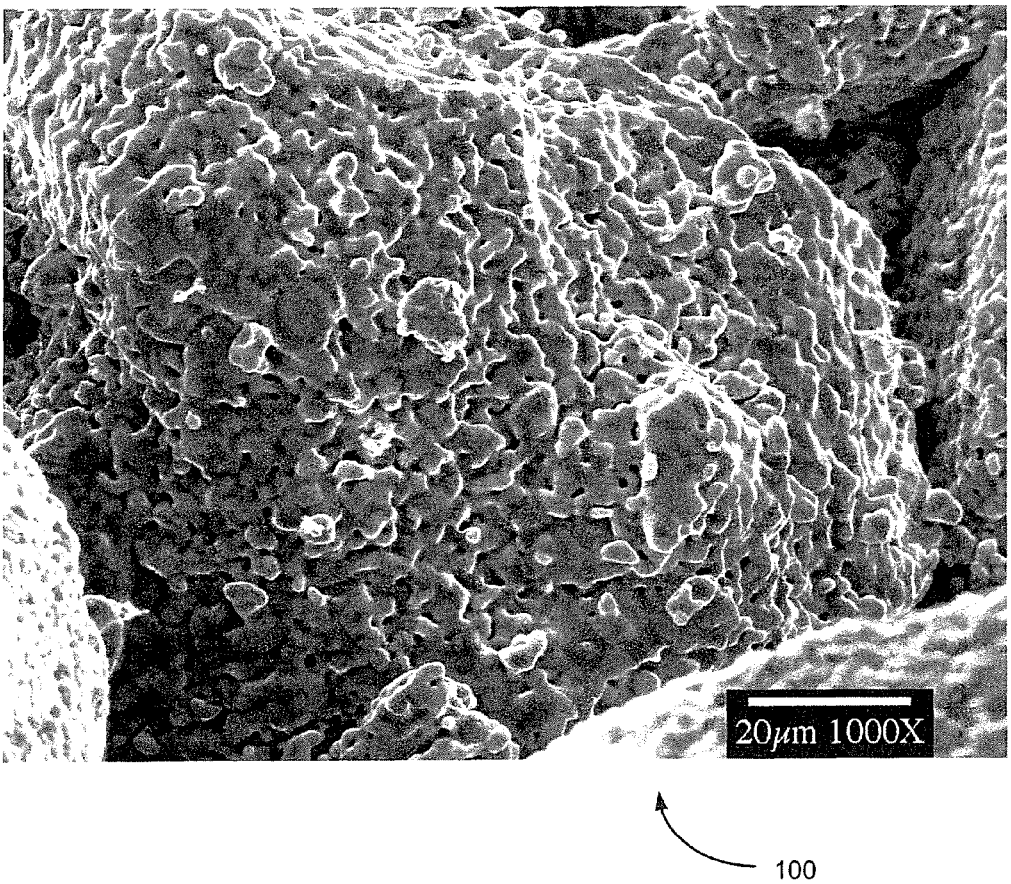
FIG. 24 is a scanning electron microscope image (20 μm 1000×) of low temperature densified molybdenum metal powder such as may be produced according to one embodiment of the present invention wherein the molybdenum metal powder precursor material is densified at a temperature of about 1500° C.
Figure 25:
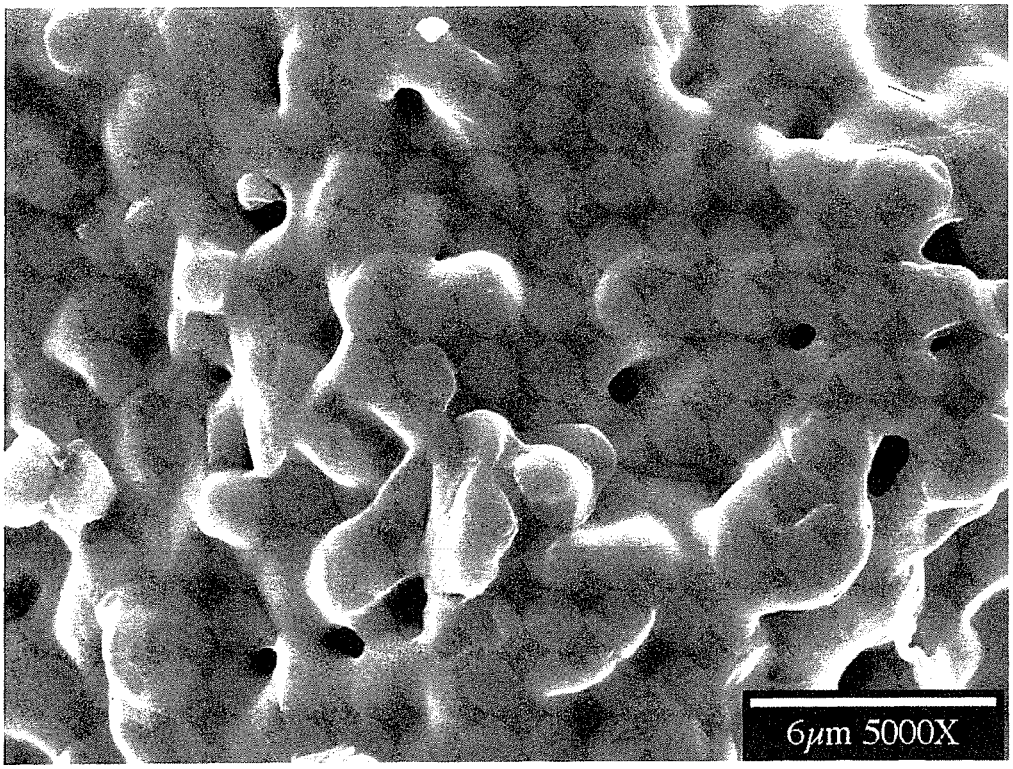
FIG. 25 is a scanning electron microscope image (6 μm 5000×) of low temperature densified molybdenum metal powder such as may be produced according to one embodiment of the present invention wherein the molybdenum metal powder precursor material is densified at a temperature of about 1500° C.
Figure 26:
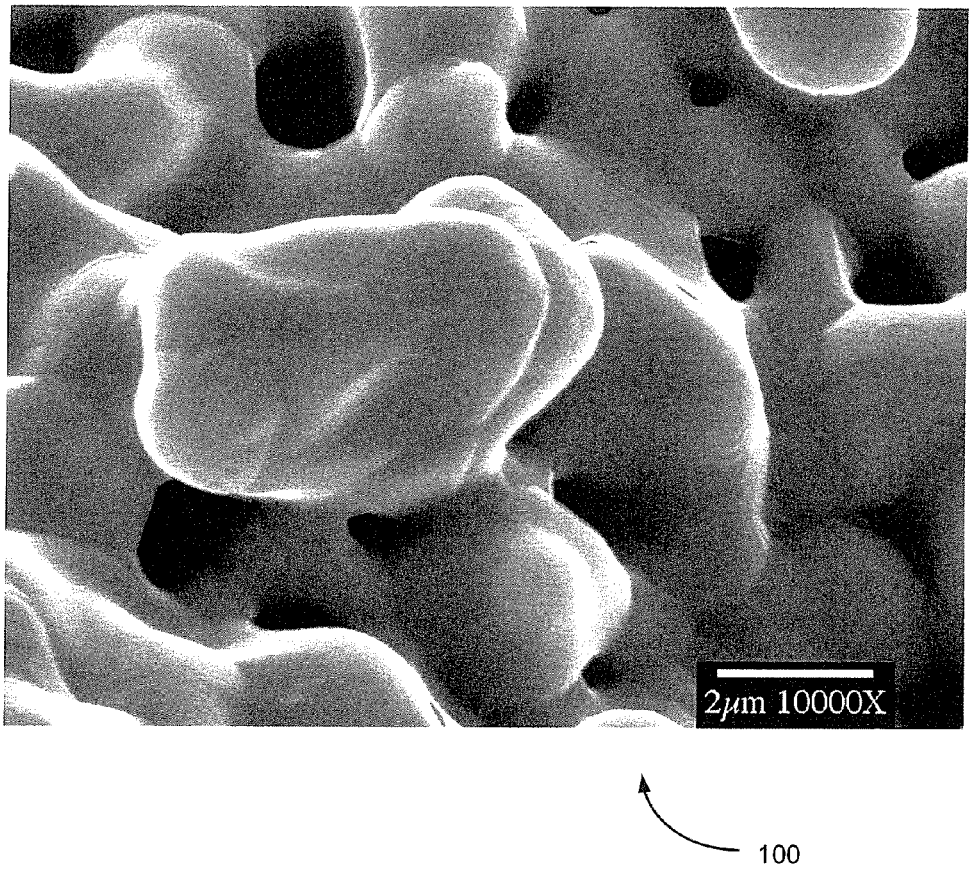
FIG. 26 is a scanning electron microscope image (2 μm 10,000×) of low temperature densified molybdenum metal powder such as may be produced according to one embodiment of the present invention wherein the molybdenum metal powder precursor material is densified at a temperature of about 1500° C.

Low temperature densified molybdenum metal powder 100 is highly flowable and comprises particles that are substantially generally spherical in form. "Spherical" as used herein means sufficiently shaped in the general form of a sphere to permit the particles to roll freely, but may contain various depressions, flattened areas and irregularities; nonetheless, the particles roll freely, do not stick together and have the flow characteristics as generally described herein. The overall shape of the particles produced through a densification process (described more fully below) is illustrated in FIGS. 12-26. The surface of the particles is porous with a stippled appearance at 1000× magnification. The appearance of the surface of the particles is illustrated in FIGS. 14, 19, and 24. The apparent density, or Scott density, of the low temperature densified molybdenum powder 100 ranges from about 2.3 g/cm$^3$ to about 4.7 g/cm$^3$ as determined by a Scott Volumeter. The flowability of low temperature densified molybdenum metal powder 100 ranges from about 16.0 s/50 g to about 31.8 s/50 g as determined by a Hall Flow meter. Tap densities were determined to be between about 3.2 g/cm$^3$ and about 5.8 g/cm$^3$. Tap densities were determined according to a procedure that would be familiar to one of skill in the art.

Densification resulting in low temperature densified molybdenum metal powder 100 removes pores between the particles of molybdenum metal powder 10 from which the low temperature densified molybdenum metal powder 100 may be made. In addition, densification according to the methods of the present invention may result in decreased particle surface area. It may also result in lowering of surface free energy. Therefore, low temperature densified molybdenum metal powder 100 has excellent flowability combined with relative high Scott density and tap density, which may result in better coatings in the case of spray coatings and better formation of parts in the case of powder injection molding, for example. The low Hall flowability time (i.e., a very flowable material) of the low temperature densified molybdenum metal powder 100 produced according to the present invention may be advantageous in powder injection molding and other metallurgical processes because the low temperature densified molybdenum metal powder 100 will readily fill mold cavities.

Low temperature densified molybdenum metal powder 100 is substantially pure, exhibiting low trace metal impurity levels and very low oxygen content of between about 0.02 and 0.1 total weight percent, preferably between about 0.0168 and 0.069 total weight percent.

The surface-area-to-mass ratio of low temperature densified molybdenum metal powder 100 ranges from about 0.06 m$^2$/g to about 0.36 m$^2$/g, as determined by BET analysis. At least about 46 percent of the particles may have a particle size larger than a +140 standard Tyler mesh sieve. At least about 13 percent of the particles may have a particle size smaller than a −100 standard Tyler mesh sieve and larger than a +140 standard Tyler mesh sieve. At least about 10.5 percent of the particles may have a particle size smaller than a −140 standard Tyler mesh sieve and larger than a +200 standard Tyler mesh sieve. At least about 11 percent of the particles may have a particle size smaller than a −200 standard Tyler mesh sieve and larger than a +325 standard Tyler mesh sieve. Additional information about the characteristics of low temperature densified molybdenum powder 100 is shown in Tables 10 to 15, as more fully described below.

Plasma Densified Molybdenum Metal Powder

Figure 27:
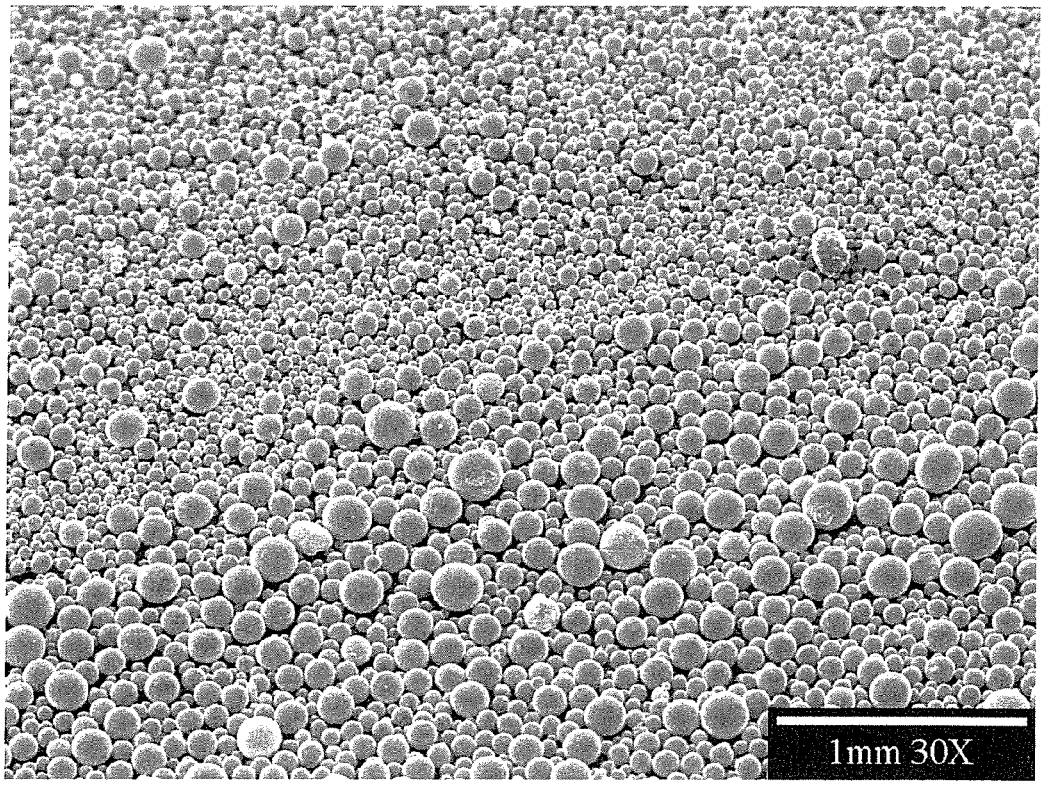
FIG. 27 is a scanning electron microscope image (1 mm 30×) of plasma densified molybdenum metal powder such as may be produced according to one embodiment of the present invention wherein the molybdenum metal powder precursor material is densified in plasma.
Figure 28:
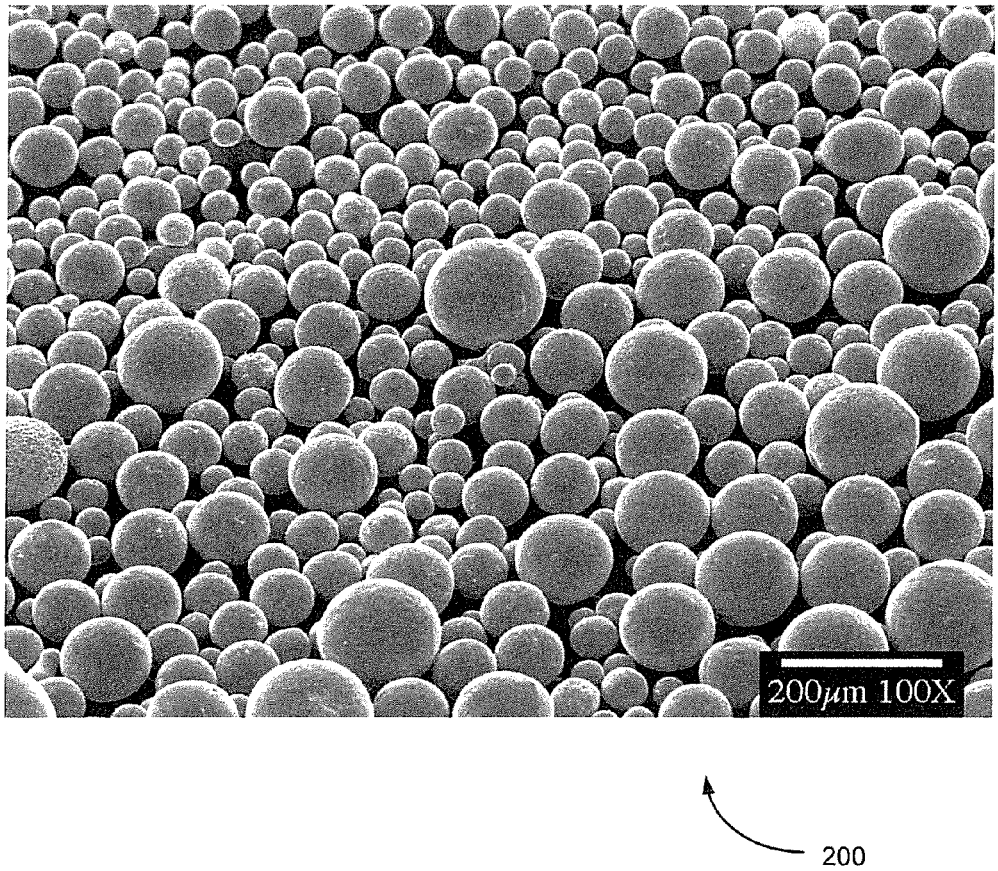
FIG. 28 is a scanning electron microscope image (200 μm 100×) of plasma densified molybdenum metal powder such as may be produced according to one embodiment of the present invention wherein the molybdenum metal powder precursor material is densified in plasma.
Figure 29:
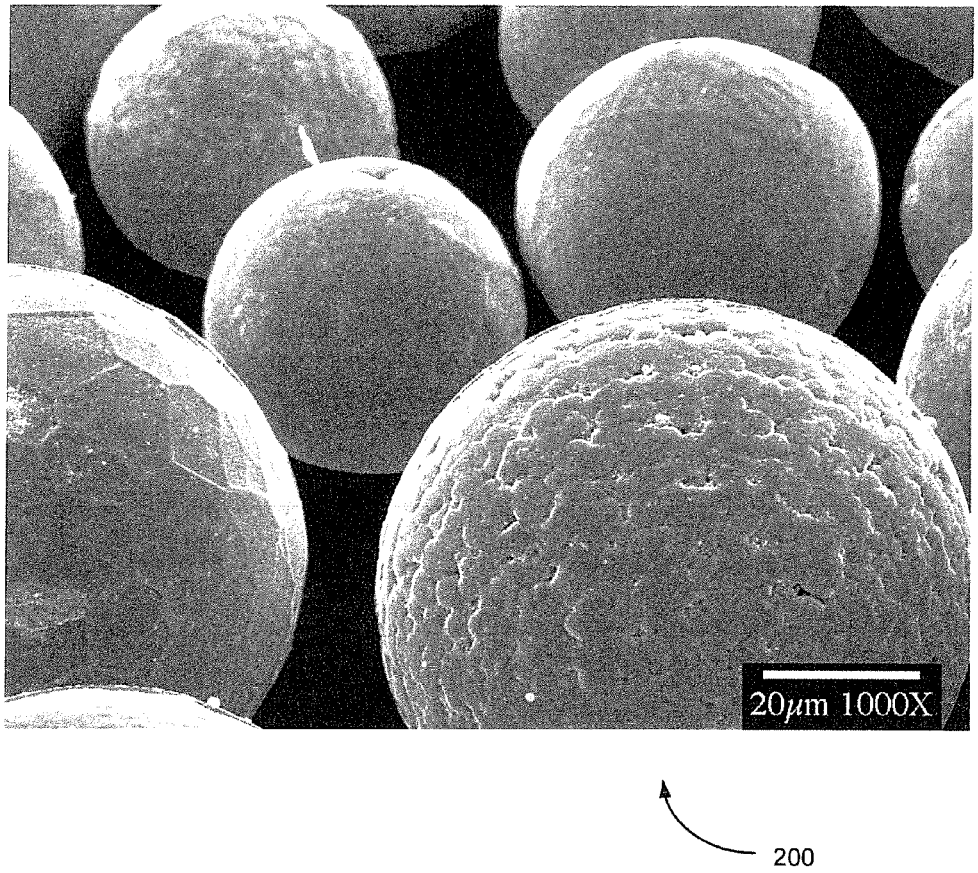
FIG. 29 is a scanning electron microscope image (20 μm 1000×) of plasma densified molybdenum metal powder such as may be produced according to one embodiment of the present invention wherein the molybdenum metal powder precursor material is densified in a plasma.
Figure 30:
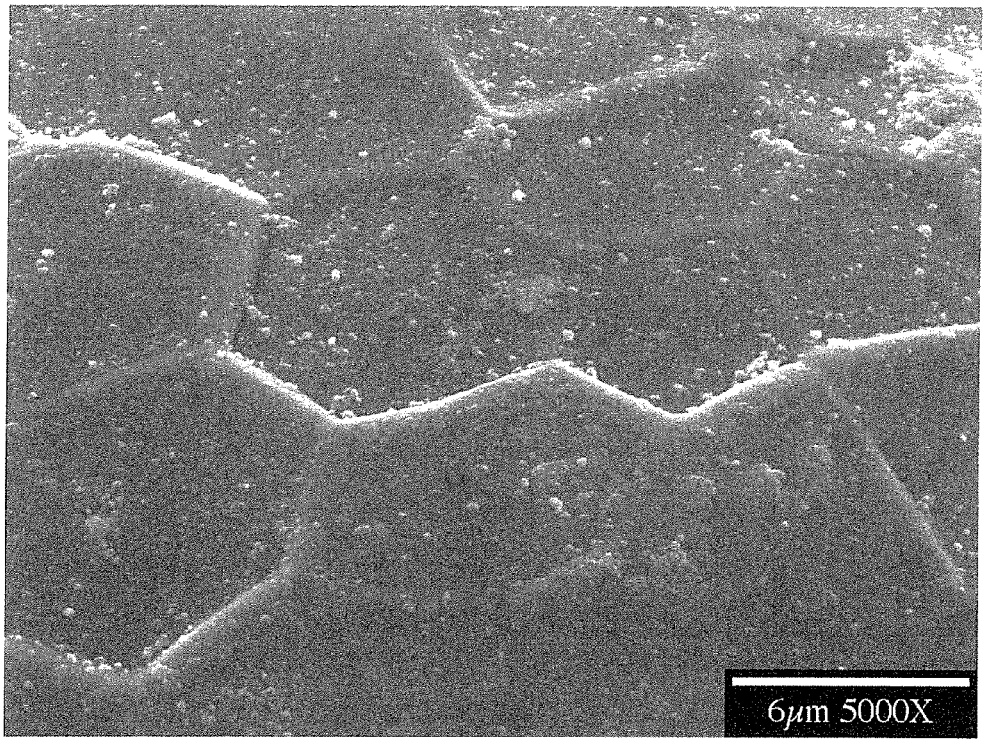
FIG. 30 is a scanning electron microscope image (6 μm 5000×) of plasma densified molybdenum metal powder such as may be produced according to one embodiment of the present invention wherein the molybdenum metal powder precursor material is densified in plasma.
Figure 31:
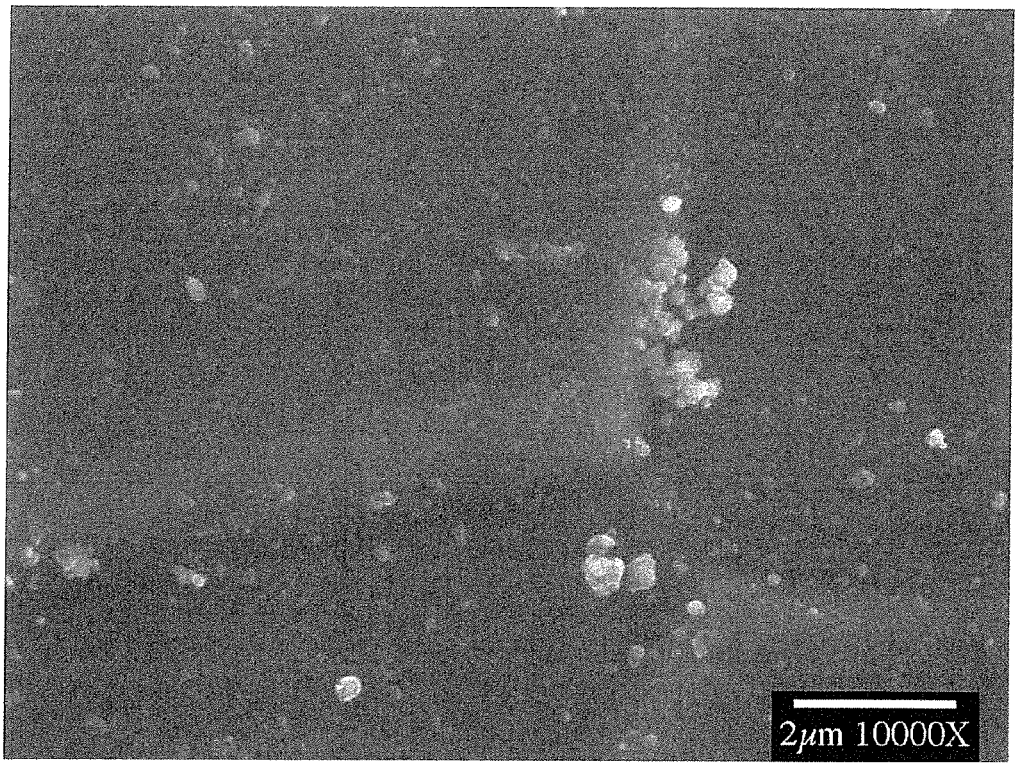
FIG. 31 is a scanning electron microscope image (2 μm 10,000×) of plasma densified molybdenum metal powder such as may be produced according to one embodiment of the present invention wherein the molybdenum metal powder precursor material is densified in plasma.

The molybdenum powder 10 described above may also be subjected to a plasma densification process to produce plasma densified molybdenum metal powder 200. The overall particle shape of plasma densified molybdenum metal 200 is regular and highly spherical, as illustrated in FIGS. 27-29. The surface of the particles of plasma densified molybdenum metal 200 is generally smooth in appearance at 1000× magnification as shown in FIG. 29. Illustrations of the surface at higher magnification are shown in FIGS. 30-31. The flowability of plasma densified molybdenum metal powder 200 was determined to be about 13.0 s/50 g. Tap density was determined to be about 6.52 g/cm$^3$. Plasma densified molybdenum metal powder 200 was determined to have an oxygen content of about 0.012 weight percent. As mentioned above, lower weight percent of oxygen enhances subsequent metallurgical processes.

Apparatus for Producing Densified Molybdenum Metal Powder

Figure 32:
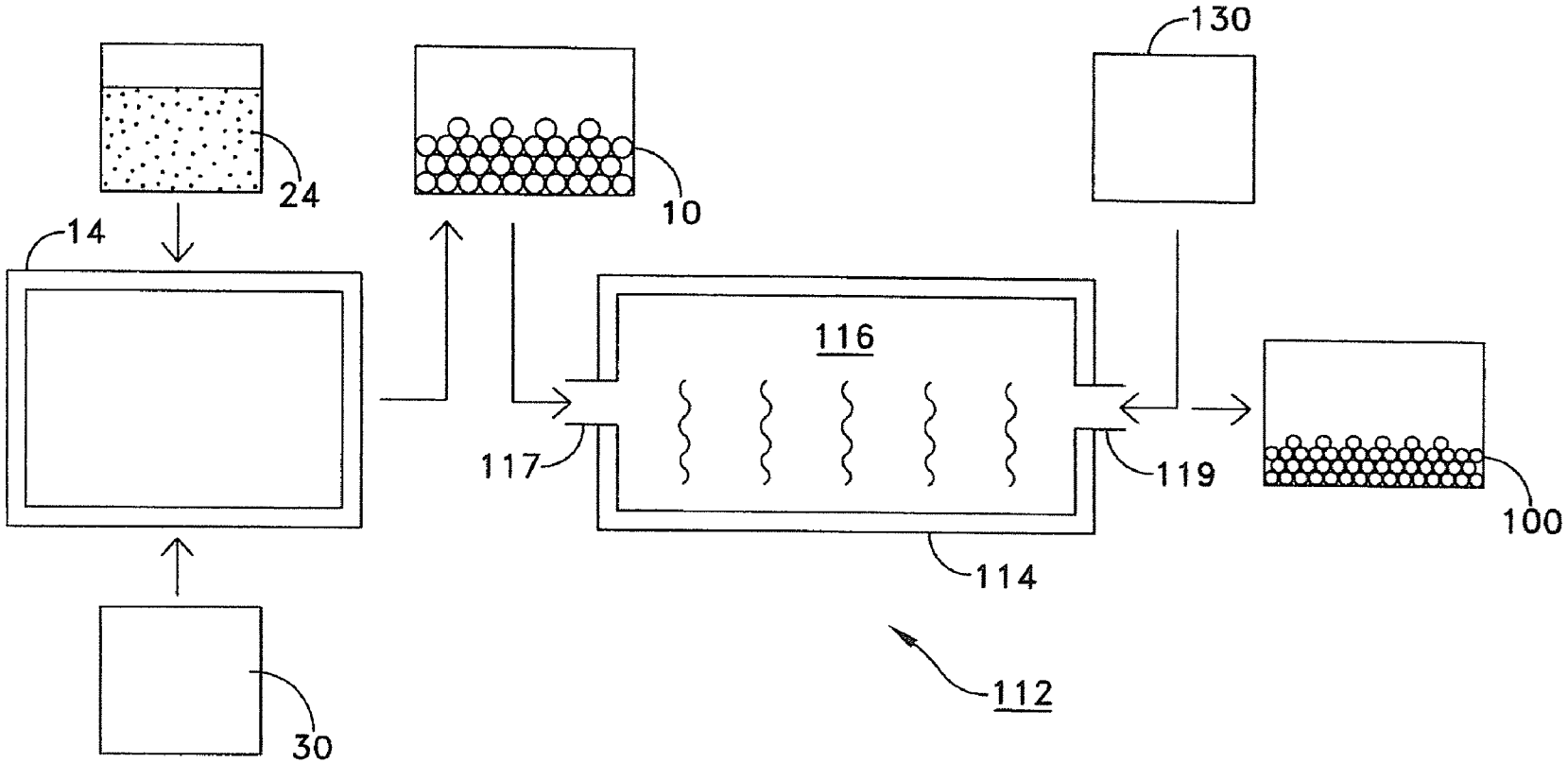
FIG. 32 is a schematic representation of apparatus used to produce low temperature densified molybdenum powder in accordance with a method of the present invention.

FIG. 32 is a schematic representation of apparatus 112 used to produce low temperature densified molybdenum powder 100 according to an embodiment of the present invention.

Apparatus 112 may comprise a supply of ammonium molybdate precursor material 24 as described above. Ammonium molybdate precursor material 24 may be fed into furnace 14, which has been previously described. The furnace 14 may further be connected to the supply of reducing gas 30, which may comprise hydrogen gas. As described above, the supply of reducing gas 30 may be introduced into furnace 14 in accordance with an embodiment of the invention to produce molybdenum metal powder 10 as an intermediate product.

As part of a continuous process or batch process, molybdenum metal powder 10 may then be introduced into furnace 114, which has at least one heating zone 116. Furnace 114 may be any suitable conventional furnace of the type known in the art, including a pusher furnace or a single-stage batch furnace. As would be familiar to one of skill in the art, furnace 114 may also comprise a preheating zone and/or a cooling zone (neither of which is shown). Furnace 114 may be connected to a supply of reducing gas 130, which may comprise hydrogen gas or any other suitable reducing gas, so that molybdenum metal powder 10 may be densified in the at least one heating zone 116 in the presence of reducing gas 130. In one embodiment of the present invention, furnace 114 has an inlet end 117 and an outlet end 119, so that the molybdenum metal powder 10 may be introduced into furnace 114 through inlet end 117, while the supply of reducing gas 130 may be introduced into the outlet end 119 allowing the reducing gas 130 to travel in a direction opposite to that of the molybdenum metal powder 10. After molybdenum metal powder 10 has been densified in furnace 114 according to a method of the present invention, low temperature densified molybdenum metal powder 100 is produced.

Apparatus 112 that may be used in one embodiment of the method of the present invention comprises a pusher furnace with at least one heating zone 116. The furnace 114 may comprise more than one heating zone, although all of the heating zones may be raised to a substantially uniform temperature. The furnace 114 may also comprise at least one preheating zone, the temperature of which should not exceed 900° C. The furnace 114 may also comprise at least one boat or container connected to a pusher mechanism that allows the boat to travel through the at least one heating zone 116 at a desired rate (e.g., 1.27 centimeters (0.5 inches) per minute). Apparatus 112 may further comprise the supply of reducing gas 130 that may be fed into the furnace 114 near its outlet end 119 in a direction opposite to that traveled by the precursor material comprising molybdenum metal powder 10. The apparatus 112 may further comprise a cooling zone (not shown). As would be familiar to one of skill in the art, the apparatus 112 may further comprise loading and unloading systems (not shown).

Apparatus for Producing Plasma Densified Molybdenum Metal Powder

Figure 33:
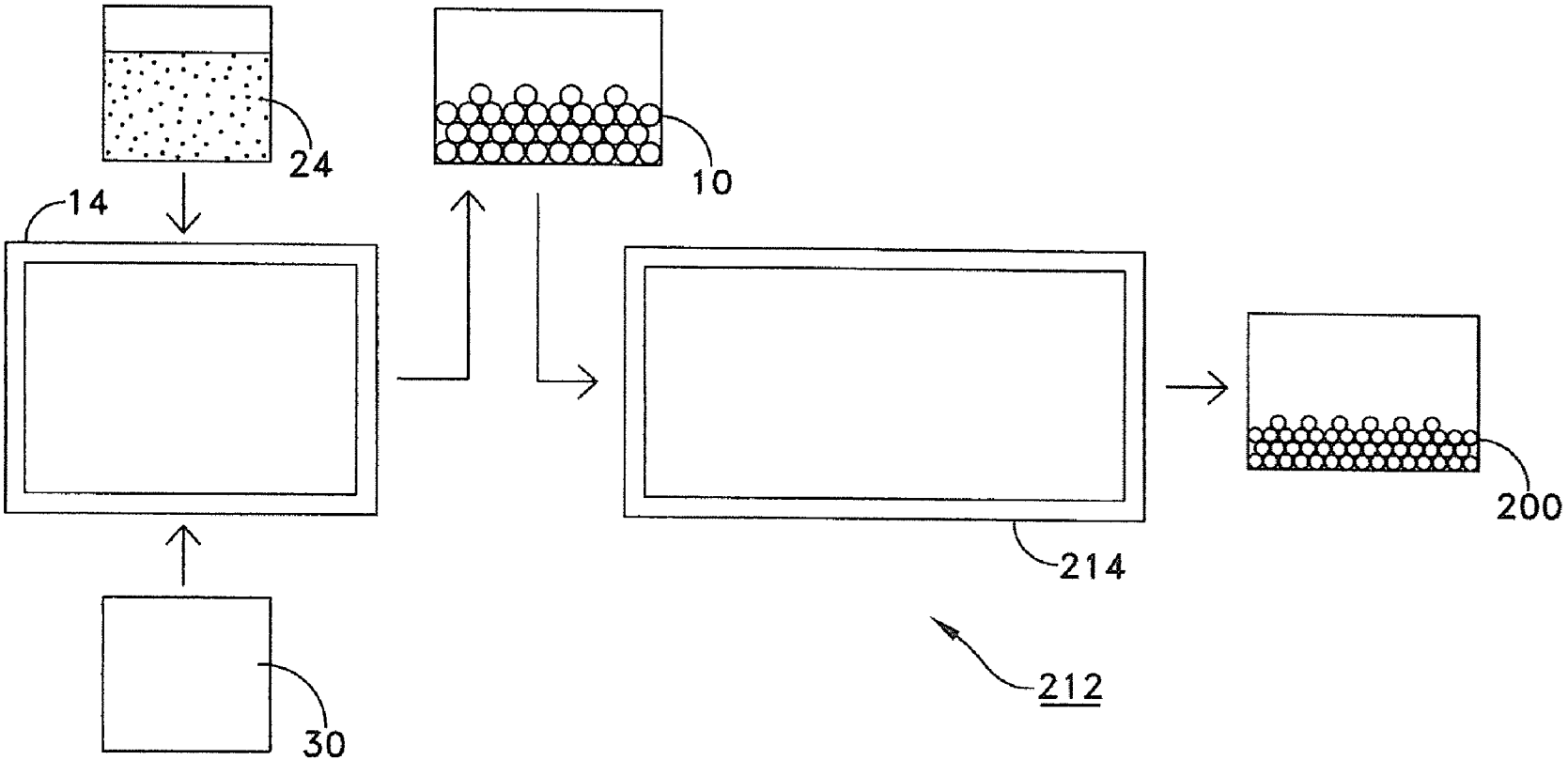
FIG. 33 is a schematic representation of apparatus used to produce plasma densified molybdenum powder in accordance with a method of the present invention.

FIG. 33 is a schematic representation of apparatus 212 used to produce plasma densified molybdenum powder 200 according to an embodiment of the present invention.

Apparatus 212 may comprise the supply of ammonium molybdate precursor material 24 as described above. Ammonium molybdate precursor material 24 may be fed into furnace 14, which has been previously described. The furnace 14 may further be connected to the supply of reducing gas 30, which may comprise hydrogen gas. As described above, the supply of reducing gas 30 may be introduced into the furnace 14 in accordance with an embodiment of the invention to produce molybdenum metal powder 10 as an intermediate product.

As part of a continuous process or separately, molybdenum metal powder 10 may then be introduced into plasma induction furnace 214. Plasma induction furnace 214 may be any plasma induction furnace of a type that would be familiar to one of skill in the art. By subjecting molybdenum metal powder 10 to a plasma densification process according to an embodiment of the present invention described below, plasma densified molybdenum metal powder 200 is produced.

METHOD FOR PRODUCING DENSIFIED MOLYBDENUM METAL POWDER

Method for Producing Low Temperature Densified Molybdenum Metal Powder

According to one embodiment of the present invention, the method for producing low temperature densified molybdenum metal powder 100 begins with providing the supply of precursor material comprising molybdenum metal powder 10. The supply of reducing gas 130 may also be provided. The precursor material comprising molybdenum metal powder 10 is densified in the presence of the reducing gas 130, creating low temperature densified molybdenum metal powder 100. The reducing gas 130 may be any suitable reducing gas, such as hydrogen gas.

More specifically, another embodiment of the present invention comprises introducing into furnace 114, having at least one heating zone 116, the supply of precursor material comprising molybdenum metal powder 10. Depending on the type of furnace employed, introducing the supply of the precursor material comprising molybdenum metal powder 10 may be done manually, in the case of a single-stage batch furnace, or may be done continuously, such as by a loading system in the case of a pusher furnace, for example, or by any other method as would be familiar to one of skill in the art. The method further comprises introducing reducing gas 130, preferably hydrogen, which may be introduced at the same time the precursor material of molybdenum metal powder 10 is introduced, or as soon thereafter as is practicable depending on the type of furnace 14 used. The precursor material of molybdenum metal powder 10 may then be densified in the at least one heating zone 116 in the presence of reducing gas 130 by heating the molybdenum metal powder 10 at a substantially uniform temperature selected from a range of between about 1065° C. to about 1500° C. for a desired time period, preferably between about 45 minutes to about 320 minutes. The low temperature densified molybdenum metal powder 100 is thereby produced.

In another embodiment of the method of the invention, furnace 114 may comprise at least one preheating zone. Thus, the method may also comprise preheating the precursor material comprising molybdenum metal powder 10 in the at least one preheating zone wherein the temperature of the preheating zone may not exceed about 900° C.

In another embodiment of the method of the present invention, furnace 114 has an inlet end 117 and an outlet end 119. The reducing gas 130 may be introduced at the outlet end 119 of furnace 114 so that it may travel through the furnace 114 in a direction opposite to that of the precursor material comprising molybdenum metal powder 10.

In another embodiment of the method of the present invention, the low temperature densified molybdenum metal powder 100 may be cooled in a reducing environment to avoid or minimize re-oxidation. In addition, cooling may permit the low temperature densified molybdenum metal powder to be immediately handled.

It should be noted that the method of the present invention should not be limited to use with a pusher furnace. Any densification means, including any suitable furnace as would be familiar to one of skill in the art, may be used to perform the method of the invention, including a batch furnace or a pusher furnace with boats or containers to hold the molybdenum metal powder 10 precursor material.

Method for Producing Plasma Densified Molybdenum Metal Powder

In yet another embodiment, the molybdenum metal powder 10 precursor material may be fed into plasma induction furnace 214 such as would be familiar to those of skill in the art. As is known, plasma induction furnaces may operate at extremely high temperatures (e.g., in excess of 10,000° C.). The molybdenum metal powder 10 may then be subjected to in-flight heating and melting in plasma. Molten spherical droplets may then be formed and gradually cooled under free-fall conditions. During melting of molybdenum metal powder 10 precursor material, the high plasma temperature may cause the vaporization and driving off of any impurities with low melting points relative to molybdenum metal powder 10. Flight time for the molten spherical droplets may be controlled so that the particles can completely solidify into plasma densified molybdenum metal powder 200 by the time the particles reach the bottom of the reaction chamber. The plasma densified molybdenum metal powder 200 may then be collected.

Whether one selected densification temperature (in the range of between about 1065° C. to about 1500° C.) is preferable over another, or whether plasma densification is preferable, may depend on the tradeoff between the desired density of the resulting densified molybdenum metal powder and the costs associated with obtaining it. For example, as is explained more fully below, according to methods of the present invention, the higher the relative temperature (within the ranges disclosed herein) used, the higher the density (e.g., Scott and tap densities) of the low temperature densified molybdenum metal powder 100 may be. And, if a plasma induction process is used with its extremely high temperatures, the density and flowability of the plasma densified molybdenum metal powder 200 may be increased even further over that of the low temperature densified molybdenum metal powder 100. However, the higher the temperature, the more energy required and the more costly the process. Therefore, operational concerns associated with cost may cause one to select a method using a temperature near the lower end of the range, although the low temperature densified molybdenum metal powder 100 obtained through such a method may not be quite as dense as that obtained when using a temperature near the higher end of the range and certainly not as dense as the plasma densified molybdenum metal powder 200 obtained using a plasma densification process. If cost is not a significant factor, then the method using a temperature near the higher end of the range or even the plasma induction method may indeed be preferred.

In any event, if one desires plasma densified molybdenum metal powder 200, the method of the present invention is advantageous over other plasma induction methods previously known. By first producing molybdenum metal powder 10 by methods disclosed herein, and then introducing molybdenum metal powder 10 into plasma induction furnace 214, it is possible to produce plasma densified molybdenum metal powder 200, a spherical, dense and highly flowable powder, in a minimum number of steps, and without grinding or milling either molybdenum metal 10 or ammonium molybdate precursor material 24, or both. The more efficient method of the present invention thus reduces both the cost and time associated with producing such plasma densified molybdenum metal powder 200.

It should be noted that the plasma densification method of the present invention should not be limited to use with the plasma induction furnace. Any other suitable device for generating a plasma and feeding molybdenum metal powder 10 into the plasma in a similar manner, such as a plasma arc furnace, could be used as would be familiar to one of skill in the art.

EXAMPLES 19-32

The precursor material in Examples 19-32 comprised molybdenum metal powder 10 having a surface-area-to-mass ratio of between about 2.03 $m^2/g$ and about 3.6 $m^2/g$, as determined by BET analysis. The oxygen content of the molybdenum metal powder 10 was less than about 0.5%. The flowability of the molybdenum metal powder 10 precursor material was between about 55.0 s/50 g and 63.0 s/50 g as determined by a Hall Flowmeter. The Scott density (as measured by a Scott Volumeter) was about 1.4-1.6 $g/cm^3$ and tap density was 1.7-2.0 $g/cm^3$. Characteristics of molybdenum metal powder 10 are shown in Tables 10-13 below.

The furnaces used in Examples 19-32 below were generally pusher furnaces. A first pusher furnace had a total length of about 14.48 meters (m) (47.5 ft), with multiple heating zones. The combined length of the heating zones, all of which were raised to a temperature of about 1065° C., was about 7.01 m (23 ft). A second pusher furnace had a total length of 6.45 m (254 in) with six heating zones and three preheating zones. The three preheating zones were set to about 300° C., 600° C. and 900° C., respectively. The six heating zones were a combined length of 1.22 m (48 in) and were all set to a temperature of about 1300° C. A third pusher furnace had a total length of 11.51 m (453 in) with three preheating zones, four heating zones and two cooling zones. The three preheating zones were set to about 300° C., 600° C. and 900° C., respectively. The four heating zones were a combined length of 1.83 m (72 in) and were all set to a temperature of about 1500° C.

Generally, the method of the present invention comprised placing the molybdenum metal powder 10 precursor material into flat bottom boats suitable for the selected temperature conditions. Metal boats were used for temperatures under 1300° C.; ceramic boats were used for temperatures of about 1300° C. and above. The boats containing molybdenum metal powder 10 precursor material were pushed through the inlet end 117 of the furnace 114, through the heating zones, to the outlet end 119 of the furnace 114 where low temperature densified molybdenum metal powder 100 was collected. Hydrogen gas was introduced through the outlet end 119 of the furnace so that the hydrogen gas traveled through the furnace 114 in a direction opposite to that traveled by the molybdenum metal powder 10 precursor material. The rate at which the boats were pushed through each of the furnaces could be adjusted to provide for a desired heating rate (e.g., 1.27 cm per minute (0.5 inches per minute) or 2.54 cm per minute (1.0 inches per minute)). In the case of the second and third furnaces, the molybdenum metal powder 10 precursor material first went through the above-mentioned preheating zones before going through the heating zones. In the case of the third furnace, the low temperature densified molybdenum metal powder 100 went through two cooling zones.

Once the low temperature densified molybdenum metal powder 100 was produced, its characteristics were determined by using any of Scott Volumeter for apparent density, a Hall Flowmeter for flowability, standard Tyler mesh sieves for particle size, and BET analysis for surface-area-to-mass ratios. When these measurements were taken, tap densities and oxygen content were determined by standard methods that would be familiar to one of skill in the art.

EXAMPLES 19 AND 20

With respect to Example 19, a small amount (about 4.54-9.07 kilograms (kg) (10-20 pounds)) of molybdenum metal powder 10 precursor material was introduced into the first pusher furnace and pushed through at a rate of 2.21 cm (0.87 in) per minute. The molybdenum metal powder 10 precursor material was densified at a substantially uniform temperature of about 1065° C. for about 317.2 minutes. Novel low temperature densified molybdenum metal powder 100 was produced. The same method employed with respect to Example 19 was also used with respect to Example 20, also resulting in the production of low temperature densified molybdenum metal powder 100. The characteristics of the precursor material (PM) comprising molybdenum metal powder 10 (which was reduced from AHM) are shown in the first line of Table 10.

The characteristics of the low temperature densified molybdenum metal powder 100 obtained from Examples 19 and 20 are shown in lines 2 and 3 of Table 10. The results of both Examples 19 and 20 contained in Table 10 show that low temperature densified molybdenum metal powder 100 produced in these examples has reduced oxygen content, increased density and increased flowability as compared to the molybdenum metal powder 10 used in these examples. With respect to Example 19, oxygen content of the low temperature densified molybdenum metal powder 100 was 0.069 weight percent, or about 26 percent of that for molybdenum metal powder 10. Scott density of low temperature densified molybdenum metal powder 100 increased by a factor of about 1.73 to 2.6 g/cm$^3$ and tap density increased by a factor of about 1.94 to 3.3 g/cm$^3$. Surface-area-to-mass ratio of the low temperature densified molybdenum metal powder 100 was reduced by a factor of about 6.56 to 0.36 m$^2$/g, which is consistent with increased density. No data was available as to flowability. With respect to Example 20, oxygen content of the low temperature densified molybdenum metal powder 100 was 0.049 weight percent, or about 18.1 percent of that for the molybdenum metal powder 10. Scott density of the low temperature densified molybdenum metal powder 100 increased by a factor of about 2.00 to 3.0 g/cm$^3$ and tap density increased by a factor of about 2.19 to 3.7 g/cm$^3$. Surface-area-to-mass ratio of the low temperature densified molybdenum metal powder 100 was reduced by a factor of about 9.08 to 0.26 m$^2$/g, which is consistent with increased density. Flowability increased by a factor of about 2.17 to 29.0 s/50 g. Other data about Examples 19 and 20 is shown in Table 10.

TABLE 10

| Example | Date | % $O_2$ | Scott Density g/cm$^3$ | Tap g/cm$^3$ | Hall Flow s/50 g | Particle Size 28 | +100 | −100/+140 | −140/+200 | −200/+325 | −325 | Surface Area BET (m$^2$/g) |
|---|---|---|---|---|---|---|---|---|---|---|---|---|
| PM | | 0.270 | 1.5 | 1.7 | 63.0 | 0 | 39.5 | 11.8 | 9.8 | 14.1 | 24.8 | 2.36 |
| 19 | Jan. 23, 2003 | 0.069 | 2.6 | 3.3 | NF | 0 | 33.2 | 12.8 | 10.5 | 16.1 | 27.4 | 0.36 |
| 20 | Jan. 23, 2004 | 0.049 | 3.0 | 3.7 | 29.0 | 0 | 32.0 | 14.0 | 11.5 | 16.8 | 25.7 | 0.26 |

EXAMPLE 21

With respect to Example 21, about 4.54-9.07 kg (10-20 pounds) of molybdenum metal powder 10 precursor material were introduced into the first pusher furnace and were densified at a substantially uniform temperature of about 1065° C. for about 317.2 minutes. Low temperature densified molybdenum metal powder 100 was produced. The characteristics of molybdenum metal powder 10 precursor material (PM) (which was reduced from AHM) are shown in the first line of Table 11.

The characteristics of the low temperature densified molybdenum metal powder 100 obtained from Example 21 are shown in line 2 of Table 11. The results of Example 21 contained in Table 11 show that low temperature densified molybdenum metal powder 100 produced has reduced oxygen content, increased density and increased flowability as compared to the molybdenum metal powder 10 precursor material used. With respect to Example 21, oxygen content of the low temperature densified molybdenum metal powder 100 was 0.042 weight percent, or about 21 percent of that for the molybdenum metal powder 10 precursor material. Scott density of the low temperature densified molybdenum metal powder 100 increased by a factor of about 1.87 to 2.8 g/cm$^3$ and tap density increased by a factor of about 1.95 to 3.3 g/cm$^3$. Surface-area-to-mass ratio of the low temperature densified molybdenum metal powder 100 was reduced by a factor of about 7.25 to 0.28 m$^2$/g, which is consistent with increased density. Flowability increased by a factor of about 1.87 to 31.0 s/50 g. Other data about Example 21 is shown in Table 11.

TABLE 11

| Example | Date | % $O_2$ | Scott Density g/cm$^3$ | Tap g/cm$^3$ | Hall Flow s/50 g | Particle Size 28 | +100 | −100/+140 | −140/+200 | −200/+325 | −325 | Surface Area BET (m$^2$/g) |
|---|---|---|---|---|---|---|---|---|---|---|---|---|
| PM | | 0.200 | 1.5 | 1.7 | 58.0 | 0 | 48.9 | 12.8 | 9.0 | 11.5 | 17.8 | 2.03 |
| 21 | Jan. 31, 2004 | 0.042 | 2.8 | 3.3 | 31.0 | 0 | 38.8 | 15.1 | 11.6 | 14.7 | 19.8 | 0.28 |

EXAMPLES 22-27

The characteristics of the precursor material (PM) comprising molybdenum metal powder 10 used in Examples 22-27 are shown in the first line of Table 12.

With respect to Example 22, about 4.54-9.07 kg (10-20 pounds) of molybdenum metal powder 10 precursor material were introduced into the first pusher furnace and were densified at a substantially uniform temperature of about 1065° C. at a rate of about 2.21 cm (0.87 inch) per minute (about 317.2 minutes total). Low temperature densified molybdenum metal powder 100 was produced. The characteristics of the low temperature densified molybdenum metal powder 100 obtained from Example 22 are shown in line 2 of Table 12. The results of Example 22 contained in Table 12 show that low temperature densified molybdenum metal powder 100 produced has reduced oxygen content, increased density and increased flowability as compared to the molybdenum metal powder 10 precursor material used. With respect to Example 22, oxygen content of the low temperature densified molybdenum metal powder 100 was 0.038 weight percent, or about 13.8 percent of that for the molybdenum metal powder 10 precursor material. Scott density of the low temperature densified molybdenum metal powder 100 increased by a factor of about 1.88 to 3.0 g/cm$^3$ and tap density increased by a factor of about 2.00 to 4.0 g/cm$^3$. Flowability increased by a factor of about 2.19 to 27.0 s/50 g. No data was available regarding change in surface-area-to-mass ratio. Other data about Example 22 is shown in Table 12.

With respect to Example 23, about 4.54-9.07 kg (10-20 pounds) of molybdenum metal powder 10 precursor material were introduced into the first pusher furnace and were densified at a substantially uniform temperature of about 1065° C. at a rate of about 2.21 cm (0.87 inch) per minute (about 317.2 minutes total). Low temperature densified molybdenum metal powder 100 was produced. The characteristics of the low temperature densified molybdenum metal powder 100 obtained from Example 23 are shown in line 3 of Table 12. The results of Example 23 contained in Table 12 show that low temperature densified molybdenum metal powder 100 produced has increased density and increased flowability as compared to the molybdenum metal powder 10 precursor material used. With respect to Example 23, Scott density of the low temperature densified molybdenum metal powder 100 increased by a factor of about 1.44 to 2.3 g/cm$^3$ and tap density increased by a factor of about 2.00 to 4.0 g/cm$^3$, as compared to the molybdenum metal powder 10 precursor material. Flowability increased by a factor of about 1.86 to 31.8 s/50 g. No data was available regarding change in oxygen content and surface-area-to-mass ratio.

With respect to Example 24, about 4.54-9.07 kg (10-20 pounds) of molybdenum metal powder 10 precursor material were introduced into the first pusher furnace and were densified at a substantially uniform temperature of about 1065° C. for about 317.2 minutes. Low temperature densified molybdenum metal powder 100 was produced. Low temperature densified molybdenum metal powder 100 was introduced into the first pusher furnace again and the foregoing process was repeated. The characteristics of the low temperature densified molybdenum metal powder 100 obtained from Example 24 are shown in line 4 of Table 12. The results of Example 24 contained in Table 12 show that low temperature densified molybdenum metal powder 100 produced has increased density and increased flowability as compared to the molybdenum metal powder 10 precursor material used. With respect to Example 24, Scott density of the low temperature densified molybdenum metal powder 100 increased by a factor of about 1.50 to 2.4 g/cm$^3$ and tap density increased by a factor of about 1.64 to 3.2 g/cm$^3$, as compared to the precursor material comprising molybdenum metal powder 10. Flowability increased by a factor of about 2.11 to 27.9 s/50 g. No data was available regarding change in oxygen content and surface-area-to-mass ratio.

With respect to Example 25, about 4.54-9.07 kg (10-20 pounds) of molybdenum metal powder 10 precursor material were introduced into the second pusher furnace and were densified at a substantially uniform temperature of about 1300° C. at a rate of about 2.54 cm (1.0 inch) per minute (about 96 minutes total). Low temperature densified molybdenum metal powder 100 was produced. The characteristics of the low temperature densified molybdenum metal powder 100 obtained from Example 25 are shown in line 5 of Table 12. The results of Example 25 contained in Table 12 show that low temperature densified molybdenum metal powder 100 produced has reduced oxygen content, increased density and increased flowability as compared to the molybdenum metal powder 10 precursor material used. With respect to Example 25, oxygen content of the low temperature densified molybdenum metal powder 100 was 0.008 weight percent, or about 2.9 percent of that for the molybdenum metal powder 10 precursor material. Scott density of the low temperature densified molybdenum metal powder 100 increased by a factor of about 2.38 to 3.8 g/cm$^3$ and tap density increased by a factor of about 2.30 to 4.6 g/cm$^3$. Flowability increased by a factor of about 2.95 to 20.0 s/50 g. No data was available regarding change in surface-area-to-mass ratio. Other data about Example 25 is shown in Table 12.

With respect to Example 26, about 4.54-9.07 kg (10-20 pounds) of molybdenum metal powder 10 precursor material were introduced into the second pusher furnace and were densified at a substantially uniform temperature of about 1300° C. at a rate of about 1.27 cm (0.5 in) per minute (about 48 minutes total). Low temperature densified molybdenum metal powder 100 was produced. The characteristics of the low temperature densified molybdenum metal powder 100 obtained from Example 26 are shown in line 6 of Table 12. The results of Example 26 contained in Table 12 show that low temperature densified molybdenum metal powder 100 produced has increased density and increased flowability as compared to the molybdenum metal powder 10 precursor material used. With respect to Example 26, Scott density of the low temperature densified molybdenum metal powder 100 increased by a factor of about 2.44 to 3.9 g/cm$^3$ and tap density increased by a factor of about 2.55 to 5.1 g/cm$^3$. Flowability increased by a factor of about 3.26 to 18.1 s/50 g. No data was available regarding change in oxygen content and surface-area-to-mass ratio. Other data about Example 26 is shown in Table 12.

With respect to Example 27, about 4.54-9.07 kg (10-20 pounds) of molybdenum metal powder 10 precursor material were introduced into the third pusher furnace and were densified at a substantially uniform temperature of about 1500° C. at a rate of about 2.54 cm (1.0 in) per minute (about 72 minutes total). Low temperature densified molybdenum metal powder 100 was produced. The characteristics of the low temperature densified molybdenum metal powder 100 obtained from Example 27 are shown in line 7 of Table 12. The results of Example 27 contained in Table 12 show that low temperature densified molybdenum metal powder 100 produced has reduced oxygen content, increased density and increased flowability as compared to the molybdenum metal powder 10 precursor material used. With respect to Example 27, oxygen content of the low temperature densified molybdenum metal powder 100 was 0.010 weight percent, or about 3.6 percent of that for molybdenum metal powder 10 precursor material. Scott density of the low temperature densified molybdenum metal powder 100 increased by a factor of about 2.93 to 4.7 g/cm$^3$ and tap density increased by a factor of about 2.9 to 5.8 g/cm$^3$, as compared to the precursor material comprising molybdenum metal powder 10. Flowability increased by a factor of about 3.67 to 16.0 s/50 g. No data was available regarding change in surface-area-to-mass ratio.

6.7 percent of that for the precursor material comprising molybdenum metal powder 10. Scott density of the low temperature densified molybdenum metal powder 100 increased by a factor of about 2.0 to 2.8 g/cm$^3$ and tap density increased by a factor of about 2.16 to 3.6 g/cm$^3$. Flowability increased by a factor of about 1.94 to 28.3 s/50 g. No data was available regarding change in surface-area-to-mass ratio. Other data about Example 28 is shown in Table 13.

With respect to Example 29, a much larger amount, about 27.22 kg (60 pounds) of molybdenum metal powder 10 precursor material than had been used in Examples 19-28 was introduced into the first pusher furnace and was densified at a substantially uniform temperature of about 1065° C. at a rate of about 2.21 cm (0.87 in) per minute (about 317.2 minutes total). Low temperature densified molybdenum metal powder 100 was produced. The larger quantity of molybdenum metal powder 10 precursor material was used to determine whether repeatable results could be obtained in terms of the low temperature densified molybdenum metal powder 100 using a commercially viable quantity of molybdenum metal powder 10 precursor material. The characteristics of the low temperature densified molybdenum metal powder 100 obtained from Example 29 are shown in line 3 of Table 13. The results of Example 29 contained in Table 13 show that low temperature densified molybdenum metal powder 100 produced has reduced oxygen content, increased density and increased flowability as compared to the molybdenum metal powder 10 used. With respect to Example 29, oxygen content of the low temperature densified molybdenum metal powder 100 was

TABLE 12

| Example | Date | % $O_2$ | Scott Density g/cm$^3$ | Tap g/cm$^3$ | Hall Flow s/50 g | Particle Size 28 | +100 | −100/+140 | −140/+200 | −200/+325 | −325 | Fisher SSS FSS | Porosity | Surface Area BET (m$^2$/g) |
|---|---|---|---|---|---|---|---|---|---|---|---|---|---|---|
| PM | | 0.275 | 1.6 | 2.0 | 59.0 | 0 | 43.8 | 14.6 | 10.5 | 12.8 | 17.2 | 5.2 | 0.820 | 2.17 |
| 22 | | 0.038 | 3.0 | 4.0 | 27.0 | 0 | 38.1 | 18.1 | 12.1 | 14.6 | 17.5 | 15.0 | 0.665 | |
| 23 | Nov. 15, 2004 | | 2.3 | | 31.8 | 0 | | | | | | | | |
| 24 | Nov. 16, 2004 | | 2.4 | | 27.9 | 0 | | | | | | | | |
| 25 | | 0.008 | 3.8 | 4.6 | 20.0 | 0 | 30 | 20.2 | 14.7 | 17.9 | 17.2 | | | |
| 26 | Nov. 30, 2004 | | 3.9 | 5.1 | 18.1 | 0 | 33.3 | 20.6 | 14.1 | 16.3 | 15.7 | | | |
| 27 | Jan. 12, 2005 | 0.010 | 4.7 | 5.8 | 16.0 | | 28.6 | 20.3 | 14.7 | 18.2 | 18.2 | | | |

EXAMPLES 28-32

The precursor material (PM) used in Examples 28-32 was produced in Example 17 above. The characteristics of the precursor material (PM) comprising molybdenum powder metal powder 10 (reduced from AHM) used in Examples 28-32 are shown in the first line of Table 13.

With respect to Example 28, about 4.54-9.07 kg (10-20 pounds) of molybdenum metal powder 10 precursor material were introduced into the first pusher furnace and were densified at a substantially uniform temperature of about 1065° C. at a rate of about 2.21 cm (0.87 in) per minute (about 317.2 minutes total). Low temperature densified molybdenum metal powder 100 was produced. The characteristics of the low temperature densified molybdenum metal powder 100 obtained from Example 28 are shown in line 2 of Table 13. The results of Example 28 contained in Table 13 show that low temperature densified molybdenum metal powder 100 produced has reduced oxygen content, increased density and increased flowability as compared to the molybdenum metal powder 10 precursor material used. With respect to Example 28, oxygen content of low temperature densified molybdenum metal powder 100 was about 0.0298 weight percent, or 0.0498 weight percent, or about 11 percent of that for the molybdenum metal powder 10 precursor material. Scott density of the low temperature densified molybdenum metal powder 100 increased by a factor of about 2.5 to 3.5 g/cm$^3$ and tap density increased by a factor of about 2.64 to 4.5 g/cm$^3$. Flowability increased by a factor of about 2.62 to 21.0 s/50 g. Surface-area-to-mass ratio of the low temperature densified molybdenum metal powder 100 was reduced by a factor of about 15.65 to 0.23 m$^2$/g, which is consistent with increased density. Other data about Example 29 is shown in Table 13.

Example 30 was prepared by removing particles of a certain size from low temperature densified molybdenum metal powder 100 produced in Example 29. Particles retained on a +100 Tyler mesh sieve and particles passing through a −325 Tyler mesh sieve were removed from Example 29 to make Example 30. As shown in Table 13, in Example 30, density was reduced slightly and Hall flowability increased slightly as compared to the results from Example 29. Other data about Example 30 is shown in Table 13.

With respect to Example 31, another large quantity, e.g., 27.22 kg (60 pounds), of molybdenum metal powder 10 precursor material was introduced into the second pusher furnace and was densified at a substantially uniform temperature of about 1300° C. at a rate of about 1.27 cm (0.5 in) per minute (about 48 minutes total). Low temperature densified molybdenum metal powder 100 was produced. Again, Example 31 was performed to determine whether repeatable results could be obtained in terms of the low temperature densified molybdenum metal powder 100 using a commercially viable quantity of molybdenum metal powder 10 precursor material. The characteristics of the low temperature densified molybdenum metal powder 100 obtained from Example 31 are shown in line 5 of Table 13. The results of Example 31 contained in Table 13 show that low temperature densified molybdenum metal powder 100 produced has reduced oxygen content, increased density and increased flowability as compared to the molybdenum metal powder 10 precursor material used. With respect to Example 31, oxygen content of the low temperature densified molybdenum metal powder 100 was 0.0168 weight percent, or about 3.8 percent of that for molybdenum metal powder 10. Scott density of the low temperature densified molybdenum metal powder 100 increased by a factor of about 2.93 to 4.1 g/cm$^3$ and tap density increased by a factor of about 2.88 to 4.9 g/cm$^3$. Flowability increased by a factor of about 2.86 to 19.2 s/50 g. Surface-area-to-mass ratio of the low temperature densified molybdenum metal powder 100 was reduced by a factor of about 60 to 0.06 m$^2$/g, which is consistent with increased density. Other data about Example 31 is shown in Table 13.

Example 32 was prepared by removing particles of a certain size from low temperature densified molybdenum metal powder 100 produced in Example 31. Particles retained on a +100 Tyler mesh sieve and particles passing through a −325 Tyler mesh sieve were removed from Example 31 to make Example 32. As shown in Table 13, in Example 32, density was reduced slightly and Hall flowability increased slightly as compared to the results from Example 31. Other data about Example 32 is shown in Table 13.

TABLE 13

| Example | Date | % $O_2$ | Scott Density g/cm$^3$ | Tap g/cm$^3$ | Hall Flow s/50 g | Particle Size 28 | +100 | −100/+140 | −140/+200 | −200/+325 | −325 | Surface Area BET (m$^2$/g) |
|---|---|---|---|---|---|---|---|---|---|---|---|---|
| PM | Jan. 14, 2005 | 0.447 | 1.4 | 1.7 | 55.0 | 0 | 52.7 | 17.6 | 10.3 | 9.6 | 9.8 | 3.6 |
| 28 | Feb. 4, 2005 | 0.0298 | 2.8 | 3.6 | 28.3 | 0 | 35.9 | 21.8 | 13.5 | 14.6 | 14.2 | |
| 29 | Feb. 11, 2005 | 0.0498 | 3.5 | 4.5 | 21.0 | 0 | 36 | 26.2 | 14.8 | 13.9 | 9.6 | 0.23 |
| 30 | Feb. 11, 2005 | | 3.3 | 4.2 | 22.0 | 0 | 0 | 47.7 | 27.0 | 25.3 | 0 | |
| 31 | Feb. 15, 2005 | 0.0168 | 4.1 | 4.9 | 19.2 | 0 | 42 | 26.5 | 13.5 | 11.4 | 6.7 | 0.06 |
| 32 | Feb. 15, 2005 | | 3.8 | 4.8 | 19.0 | 0 | 0 | 52 | 26 | 22.2 | 0 | |

EXAMPLE 33

In Example 33, about 22.68 kg (50 pounds) of precursor material comprising molybdenum metal powder 10 was introduced into a plasma induction furnace manufactured and maintained by Tekna Plasma Systems, Inc. of Sherbrooke, Quebec, Canada. As is well known in the art, plasma induction furnaces operate at the extremely high temperatures necessary to produce and maintain a plasma (e.g., in excess of 10,000° C.). Characteristics of the molybdenum metal powder 10 precursor material (PM) (which was reduced from AHM) are shown in the first line of Table 14. Molybdenum metal powder 10 was subjected to in-flight heating and melting in plasma. Molten spherical droplets were formed and cooled, producing plasma densified molybdenum metal powder 200. The characteristics of the plasma densified molybdenum metal powder 200 obtained from Example 33 are shown in line 2 of Table 14. The results of Example 33 contained in Table 14 show that plasma densified molybdenum metal powder 200 produced has increased density and increased flowability as compared to the precursor material comprising molybdenum metal powder 10. With respect to Example 33, the tap density of the plasma densified molybdenum metal powder 200 increased by a factor of about 4.18 to 6.52. Oxygen content of the resulting plasma densified molybdenum powder 200 was 0.012 weight percent. Flowability increased by a factor of about 6.62 to 13 s/50 g. In addition, the degree of spheroidization of the plasma densified molybdenum metal powder 200 was over 99 percent.

TABLE 14

| Example | Date | % $O_2$ | Tap g/cm$^3$ | Hall Flow s/50 g |
|---|---|---|---|---|
| PM | | | 1.56 | 86 |
| 33 | Aug. 27, 2004 | 0.012 | 6.52 | 13 |

Figure 34:
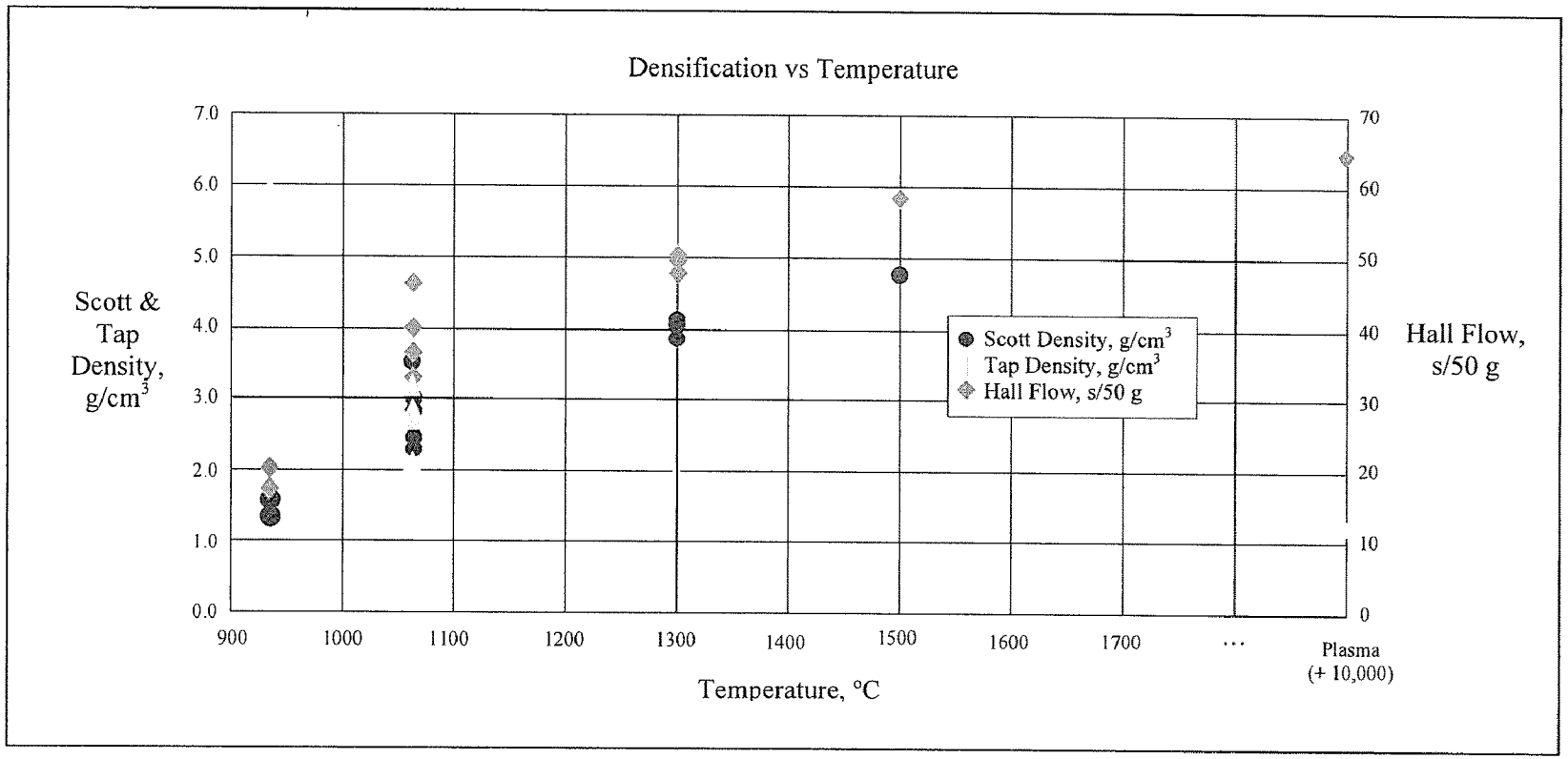
FIG. 34 is a plot of data presented in Table 15.

Table 15 below illustrates the correlation between increased density and flowability and processing temperature, thus demonstrating that the desired density of the various densified molybdenum metal powders may be achieved by increasing the temperature at which the molybdenum metal powder 10 precursor material is processed. Table 15 is a summary of selected examples from Examples 19-33. Data from Examples 22-31 and 33 are summarized in Table 15. The data from Table 15 is then plotted in graph form in FIG. 34.

TABLE 15

| Example | $O_2$ % | Scott Density g/cm$^3$ | Scott Density g/in$^3$ | Tap Density g/cm$^3$ | Hall Flow s/50 g | Temp ° C. |
|---|---|---|---|---|---|---|
| PM | 0.275 | 1.6 | 26.2 | 2.0 | 59.0 | 940 |
| 22 | 0.038 | 3.0 | 40.2 | 4.0 | 27.0 | 1065 |
| 23 | | 2.3 | 37.2 | 4.0 | 31.8 | 1065 |
| 24 | | 2.5 | 40.3 | 3.2 | 27.9 | 1065 |
| 25 | 0.008 | 3.8 | | 4.6 | 20.0 | 1300 |
| 26 | | 3.9 | 61.6 | 5.1 | 18.1 | 1300 |
| 27 | | 4.7 | 77.0 | 5.8 | 16.0 | 1500 |
| PM | 0.447 | 1.4 | 22.9 | 1.7 | 55.0 | 940 |
| 28 | 0.030 | 2.8 | 46.1 | 3.6 | 28.3 | 1065 |
| 29 | 0.050 | 3.5 | 57.4 | 4.5 | 21.0 | 1065 |
| 31 | 0.017 | 4.1 | 67.2 | 4.9 | 19.2 | 1300 |
| 33 | | | | 6.52 | 13.0 | Plasma (+10,000° C.) |

What is claimed is:

1. A densified molybdenum metal powder comprising:

particles of molybdenum metal having a surface-area-to-mass ratio of no more than about 0.5 $m^2/g$ as determined by BET analysis, a total weight percent of oxygen less than about 0.05%, and a flowability value less than about 32 s/50 g as determined by a Hall Flowmeter, said particles comprising a densified form of a molybdenum metal powder precursor material having a surface-area-to-mass ratio of between about 1 $m^2/g$ and about 4 $m^2/g$, as determined by BET analysis, and a flowability of between about 29 s/50 g and about 86 s/50 g as determined by a Hall Flowmeter.

2. The densified molybdenum metal powder of claim 1 further comprising a tap density of at least about 3 $g/cm^3$.

3. The densified molybdenum metal powder of claim 1 further comprising a Scott density of at least about 2 $g/cm^3$.

4. The densified molybdenum metal powder of claim 3 wherein said molybdenum metal powder precursor material further comprises particles having an average size of about 60 μm.

5. The densified molybdenum metal powder of claim 1 wherein at least about 45% of said particles of molybdenum metal have a particle size larger than a size +140 standard Tyler mesh sieve.

6. The densified molybdenum metal powder of claim 1 wherein said particles of molybdenum metal further comprise substantially generally spherical particles.

7. The densified molybdenum powder of claim 1 wherein said flowability value less than about 32 s/50 g further comprises flowability in a range from about 16 s/50 g to about 32 s/50 g.

* * * * *